US005579039A

United States Patent [19]

Kurata et al.

[11] Patent Number: 5,579,039

[45] Date of Patent: Nov. 26, 1996

[54] INK JET RECORDING APPARATUS

[75] Inventors: Mitsuru Kurata; Yasuo Miyauchi; Takayuki Matsuo, all of Kawasaki, Japan

[73] Assignee: Canon Kabushiki Kaisha, Tokyo, Japan

[21] Appl. No.: 229,127

[22] Filed: Apr. 18, 1994

Related U.S. Application Data

[63] Continuation of Ser. No. 737,151, Jul. 29, 1991, abandoned.

[30] Foreign Application Priority Data

| | | | |
|---|---|---|---|
| Jul. 31, 1990 | [JP] | Japan | 2-203179 |
| Aug. 31, 1990 | [JP] | Japan | 2-230324 |
| Sep. 27, 1990 | [JP] | Japan | 2-255154 |
| Sep. 28, 1990 | [JP] | Japan | 2-259162 |
| Jun. 27, 1991 | [JP] | Japan | 3-181687 |

[51] Int. Cl.[6] ..... B41J 2/01; B41J 25/34; B41J 29/54

[52] U.S. Cl. ..... 347/49; 347/23; 400/664

[58] Field of Search ..... 346/139 R, 145; 347/49, 50, 22, 108, 29, 23, 104.37; 400/663, 664, 668, 690.4, 692, 175, 352, 174

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,459,600 | 7/1984 | Sato et al. | 347/56 |
| 4,463,359 | 7/1984 | Ayata et al. | 347/56 |
| 4,530,611 | 7/1985 | Borcenk et al. | 400/175 |
| 4,558,333 | 12/1985 | Sugitani et al. | 347/65 |
| 4,577,200 | 3/1986 | Rix et al. | 347/49 |
| 4,590,494 | 5/1986 | Ichihashi et al. | 347/43 |
| 4,709,247 | 11/1987 | Piatt et al. | 347/49 |
| 4,723,129 | 2/1988 | Endo et al. | 347/56 |
| 4,736,213 | 4/1988 | Piatt et al. | 347/49 |
| 4,740,796 | 4/1988 | Endo et al. | 347/56 |
| 4,773,773 | 9/1988 | Itoh | 400/663 X |
| 5,138,342 | 8/1992 | Kurata et al. | 347/50 |
| 5,245,361 | 9/1993 | Kashimura et al. | 347/50 |

FOREIGN PATENT DOCUMENTS

| | | | |
|---|---|---|---|
| 0379151 | 7/1990 | European Pat. Off. . | |
| 54-56847 | 5/1979 | Japan . | |
| 59-123670 | 7/1984 | Japan . | |
| 59-138461 | 8/1984 | Japan . | |
| 60-71260 | 4/1985 | Japan . | |
| 60-172576 | 9/1985 | Japan . | |
| 60-172575 | 9/1985 | Japan . | |
| 0173942 | 8/1986 | Japan | 400/175 |
| 61-279573 | 12/1986 | Japan . | |
| 62-083167 | 4/1987 | Japan . | |
| 0122588 | 5/1988 | Japan | 400/690.4 |
| 0055253 | 3/1991 | Japan . | |

*Primary Examiner*—Alrick Bobb
*Attorney, Agent, or Firm*—Fitzpatrick, Cella, Harper & Scinto

[57] ABSTRACT

An ink jet recording apparatus wherein recording is effected by ejecting ink to a recording material from a recording head cartridge detachably mountable to a main assembly of the apparatus includes a carriage, movable in a main scan direction, for mounting thereon the recording head cartridge; mounting and demounting mechanism for controlling mounting and demounting of the recording head cartridge on the carriage; a controlling member for controlling operation of the mounting and demounting mechanism to permit mounting or demounting of the recording head cartridge only when the carriage is disposed outside a position where it is faced to the recording material.

19 Claims, 19 Drawing Sheets

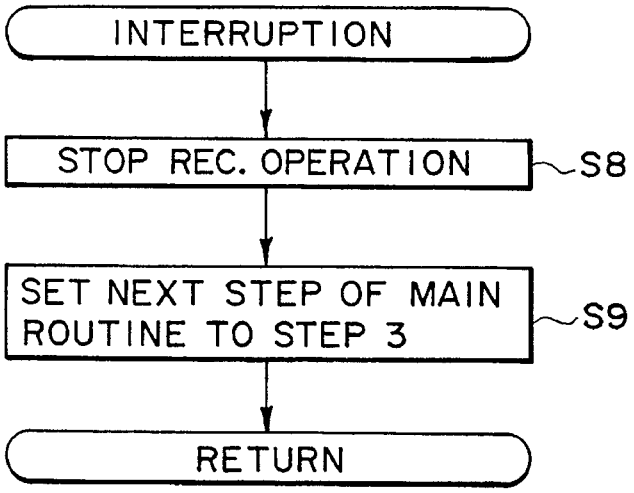
FIG. 17
FIG. 18A
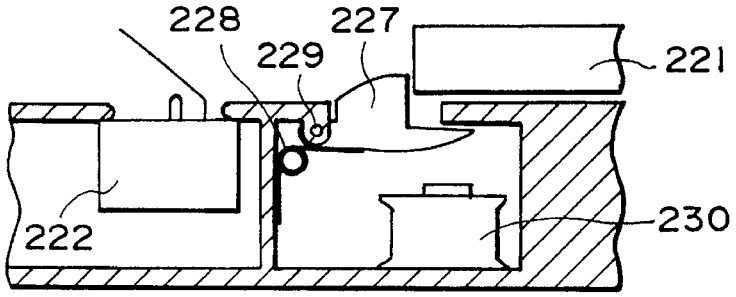
FIG. 18B
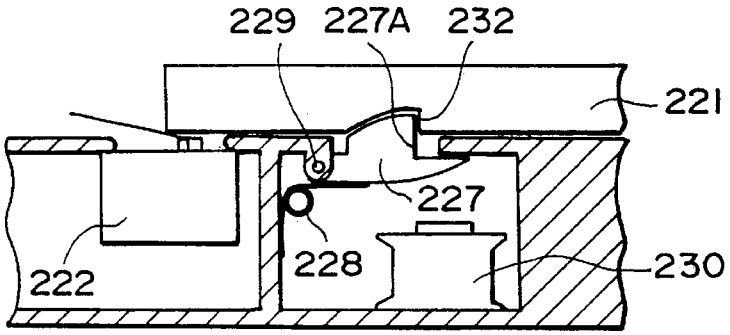
FIG. 18C
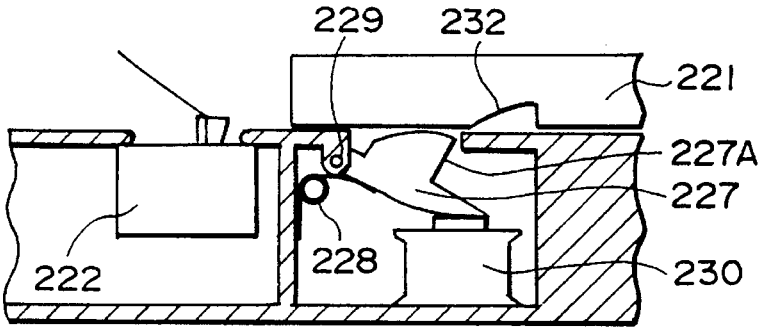

INK JET RECORDING APPARATUS

This application is a continuation of application Ser. No. 07/737,151 filed Jul. 29, 1991 abandoned.

FIELD OF THE INVENTION AND RELATED ART

The present invention relates to an ink jet recording apparatus for effecting recording by ejecting ink onto a recording material.

In the ink jet recording apparatus, ink is ejected through ejection outlets of a recording head onto a recording material. The ink jet recording apparatus has the advantages that fine images can be formed at a high speed, the apparatus is not noisy because it is of a non-impact type, and that it is easy to record a color image using ink materials having different colors.

In the ink jet recording apparatus, a replaceable recording head cartridge having an integral recording head and ink container is widely used.

Referring first to FIG. 1, there is shown an example of an ink jet recording apparatus having such a replaceable recording head cartridge. In this Figure, a carriage 1 carries four recording head cartridges 2A, 2B, 2C and 2D. The carriage 1 slides on a scanning rail 3 toward the right and left in the drawing.

The carriage 1 is scanningly driven from a driving motor 4 through a driving pulley 5 and a driving belt 6. While the carriage 1 is being moved, the ink is ejected from the recording head cartridges 2A–2D in accordance with image signals, so that an image is recorded on the recording material 7.

In the Figure, the broken lines A indicates the carriage rest position during the non-recording period. The carriage rest position is in a non-record area outside the conveyance path region of the recording material 7. When the recording operation is not carried out, or when the recording head is to be subjected to a recovery operation for recovering the ejection, the carriage 1 is moved to the rest position where the recording head is faced to capping means 8, and the recovery operation or the like is performed there.

When the carriage 1 is at the rest position A, the recording heads of the head cartridges 2A–2D are covered with capping means 8, so that evaporation of the ink is prevented.

In addition, when the head cartridge is to be replaced, the replacing operation is performed when the cartridge is at rest position, by which the ink scattering is prevented when the head cartridge is mounted or demounted.

Thus, the carriage 1 stops at the rest position indicated by the broken line A whenever the recording operation is at rest, when the apparatus is under normal conditions. However, in emergency situation such as jam (paper jam) occurrences or unexpected shut-off of the power supply, the carriage 1 may stop at a position other than the rest position.

When the head cartridges 2A–2D are to be replaced under the emergency situation, the recording head may be abutted to the recording material 7 because the clearance between the recording head of the head cartridge and the recording material 7 is as small as approximately 0.5–2 mm. If this occurs, the recording head may be damaged.

By vibration during the mounting or dismounting operation, the ink scatters from the recording head with the result of contaminating the inside of the recording apparatus.

If the ink scatters to the recording material conveying path, the backside of the next recording material 7 is contaminated.

If the carriage 1 is left at a position other than the rest position, the recording heads 2A–2D are not capped, so that the ink may evaporate with the result of an improper recording operation.

Upon the jam occurrence or upon the recording head replacement, a door of the apparatus is opened. If the operator inadvertently touches the carriage in the jam clearance operation, the carriage may be unexpectedly moved with the result of an interference between the carriage and a sheet conveying mechanism when the conveying mechanism is opened. If this occurs, the apparatus will be damaged.

In the ink jet recording system, the head is capped to prevent the ink from drying when the recording head is at the rest or home position. However, if the carriage is inadvertently moved in the jam clearance operation or the like, the capping is not done. If the apparatus is left as it is, the ink is dried with the result of improper subsequent recording.

If the recording head is replaced when the carriage is not at the rest position, and if the apparatus is left as it is, the recording head will be left without capping. If this occurs, the ink is dried with the result of improper subsequent recording.

SUMMARY OF THE INVENTION

Accordingly, it is a principal object of the present invention to provide an ink jet recording apparatus wherein the recording head is protected from damage due to contact thereof with the recording material, and from the ejection of ink due to vibration, during the mounting or dismounting of the recording head.

It is another object of the present invention to provide an ink jet recording apparatus wherein the ink is prevented from drying during the non-recording operation.

It is a further object of the present invention to provide an ink jet recording apparatus wherein the ejection side surface of an ink jet recording head is prevented from making contact with a carriage guiding surface of the carriage, so that the ejection side surface and the ejection outlets of the ink jet recording head can be protected.

It is a further object of the present invention to provide an ink jet recording apparatus wherein the recording means is kept capped when a cover (door) of the apparatus is opened for the purpose of the a jam clearance or a head replacing operation, and wherein the damage of the head by the contact between the recording means and conveying means when the conveying means is opened for the jam clearance operation.

According to an aspect of the present invention, there is provided an ink jet recording apparatus wherein recording is effected by ejecting ink to a recording material from a recording head cartridge detachably mountable to a main assembly of said apparatus, comprising: a carriage, movable in a main scan direction, for mounting thereon the recording head cartridge; a mounting and demounting mechanism for controlling mounting and demounting of the recording head cartridge on said carriage; and a controlling member for controlling operation of said mounting and demounting mechanism to permit mounting or demounting of the recording head cartridge only when said carriage is disposed outside a position where it is faced to the recording material.

According to another aspect of the present invention, there is provided an ink jet recording apparatus, comprising: an ink jet head for ejecting ink through an ejection outlet to effect recording of an image; a carriage for detachably mounting thereon said ink jet head, said carriage being movable over a recording region and a non-recording region; a carriage guiding surface provided in said carriage to guide said ink jet head when said ink jet head is mounted on said carriage; a mounting and demounting mechanism for mounting said ink jet head on said carriage and for demounting it from said carriage; and a guide for inclining an ejection side surface of said ink jet head relative to said carriage guiding surface when the mounting and demounting mechanism permits the demounting of said ink jet head.

According to a further object of the present invention, there is provided a recording head for effect recording by ejecting ink, comprising: a carriage, movable over a recording region and a non-recording region, for detachably mounting thereon said recording head; a capping member for capping the ejection side surface of said recording head when said carriage is in the non-recording region; a casing having a door for permitting mounting and demounting of said recording head and for casing said carriage member and said capping member; and control means for permitting opening or closing of said door only when a main switch of said apparatus is in an on-state.

According to a further object of the present invention, there is provided a recording apparatus having a cover openable and closable relative to a main assembly of said apparatus, comprising: conveying means for conveying a recording-material; recording means for effecting record on the recording material during relative movement therebetween; movement preventing means for preventing movement of said recording means in interrelation with opening or closing of said cover; wherein when the cover is opened, said movement preventing means prevents movement of said recording means, and when said cover is closed, the prevention by said preventing means is released.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 16 and 17 are flow charts showing an example of control operation.

FIGS. 18A–18C comprise sectional views of another example of a door locking mechanism.

DESCRIPTION OF THE PREFERRED EMBODIMENTS

Figure 1:
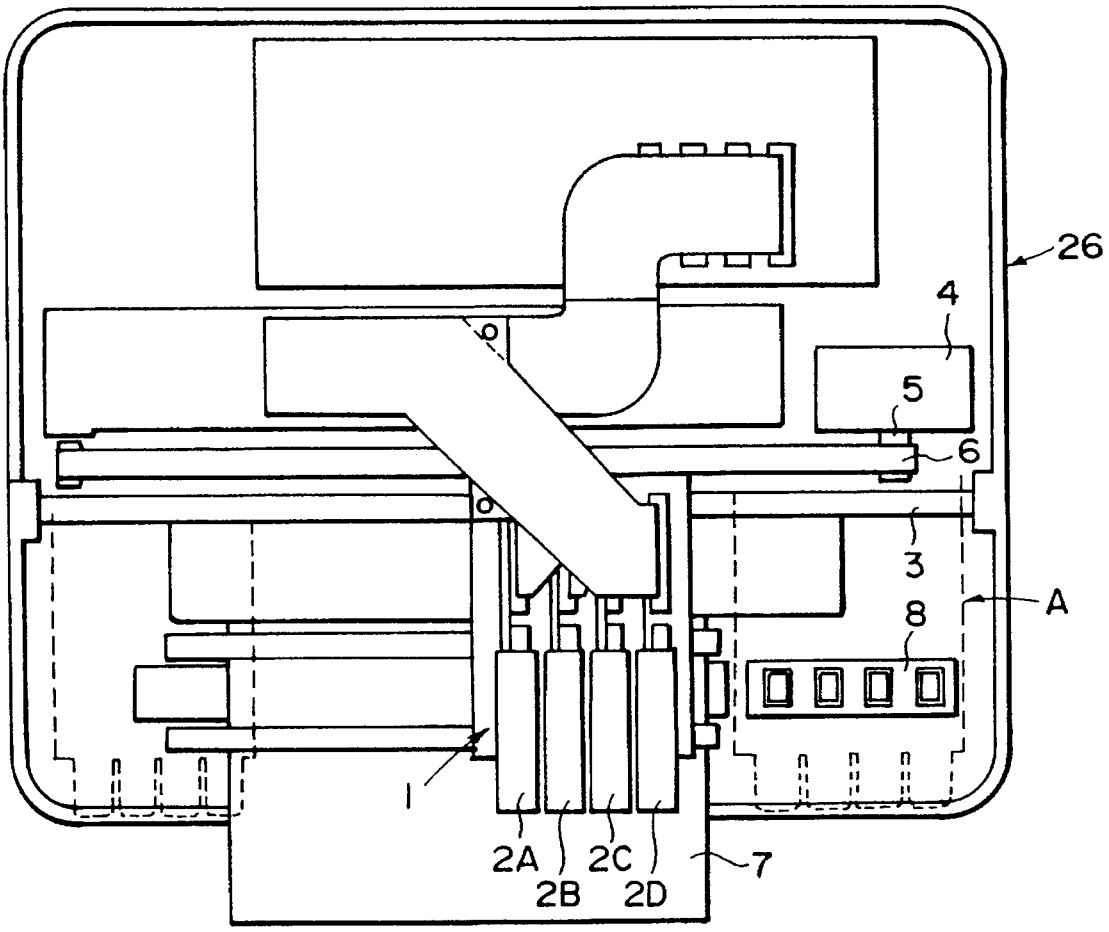
F I G. 1 PRIOR ART
FIG. 1 is a top plan view of an exemplary ink jet recording apparatus.

Referring to the accompanying drawings, the embodiments of the present invention will be described, wherein like reference numerals are assigned to the elements having corresponding functions.

Figure 2:
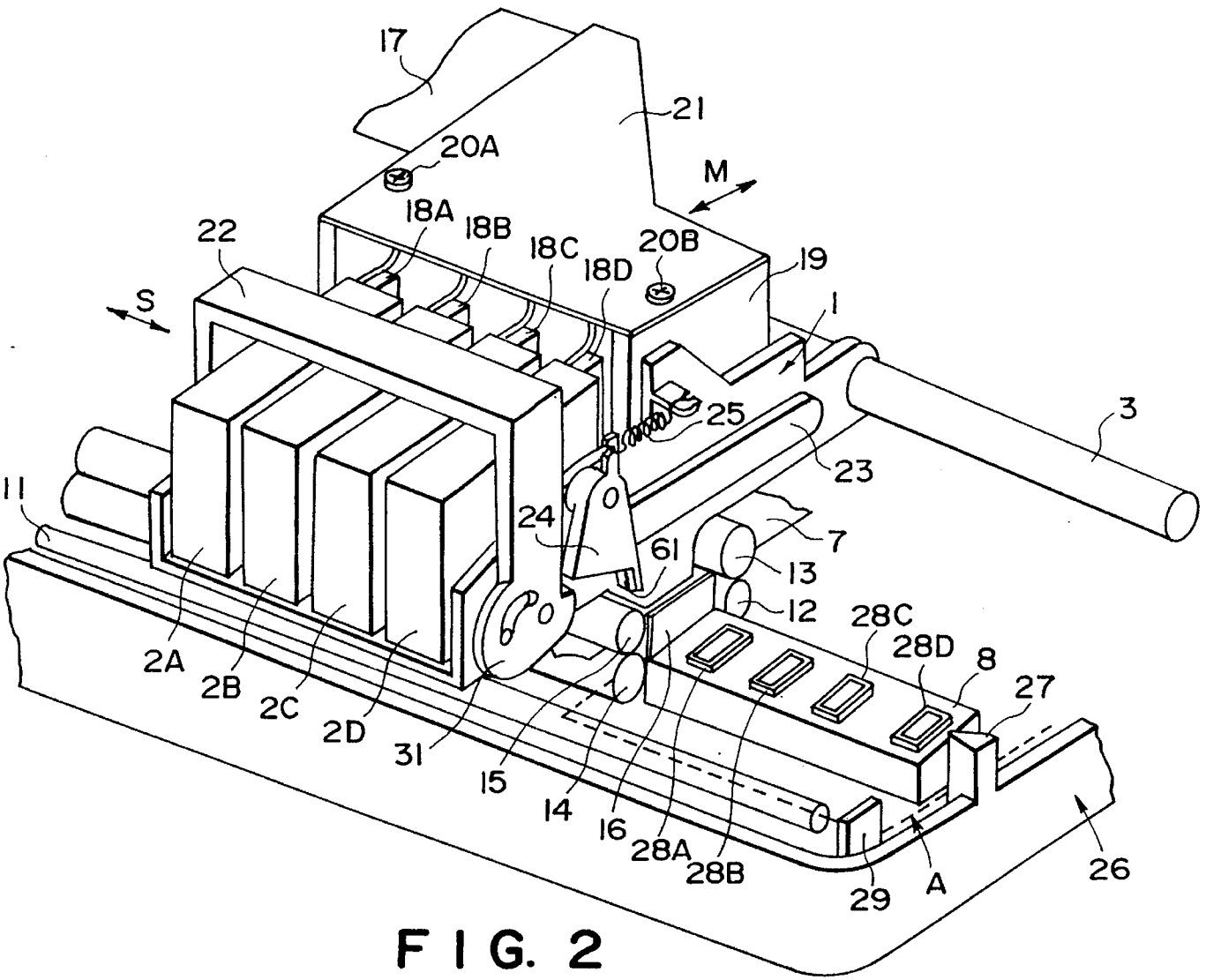
FIG. 2 is a perspective view of a major part of an exemplary ink jet recording apparatus, according to an embodiment of the present invention.

Referring to FIG. 2, there is shown an ink jet recording apparatus according to an embodiment of the present invention in a perspective view. Recording head 2A, 2B, 2C and 2D of a replaceable cartridge type, are detachably mounted on a carriage 1. The carriage 1 is movable along a scanning rail 3, and is mounted on a sliding rail 11 adjacent the other end. The carriage is reciprocated by a driving motor through a driving pulley and a driving belt in direction indicated by the arrow S relative to a recording material 7.

While the carriage 1 is moved, the ink is ejected through the ink ejection part of the recording head 2A–2D in accordance with image signal, by which an image such as character, figure or the like are recorded on the recording material 7.

The recording heads 2A–2D are of a cartridge type having an integral ink container, and the ink is supplied to the ink ejection parts from the integral ink container.

The recording heads 2A–2D effect the image recording with different ink materials. In the case of color recording, the recording heads 2A–2D provide yellow, magenta, cyan and black ink materials, for example. Each of the recording heads 2A–2D, more particularly, the ink ejection parts thereof, is in the form of an ink jet head using thermal energy to eject the ink, and therefore, is provided with an electrothermal transducer. Each of the recording head 2A–2D produces film boiling by thermal energy applied by the electrothermal transducers to cause expansion and contraction of the bubble to eject the ink through the ejection outlet, by which the image is recorded.

In the following description, when reference is made to any of the elements having the similar structure, or when reference is made to all of such elements, the suffixes A–D will be omitted so that "recording head 2" or the like will be used.

The recording material 7 is sequentially fed in accordance with the image to be recorded by feeding rollers 12 and 13, and 14 and 15. The recording material 7 is guided by a guiding plate at a lateral edge, so that the lateral position thereof is confined.

To each of the recording heads 2, the record image signals are transmitted from signal lines (flexible cable) 17 through connectors 18A, 18B, 18C and 18D. The connectors 18A–18D are supported by a connector holder 19 engaged for movement in a direction M relative to the carriage 1. The flexible cable 17 is fixed by a confining plate 21 fixed on the connector holder 19 by screws 20A and 20B. On the carriage 1, a releasing lever 22 is movably supported. The releasing lever 22 is normally effective to maintain the recording head 2 in the positioned state. At a particular carriage position which will be described hereinafter, it is rotated to release the recording head 2.

On the carriage 1, there is provided a link plate 23 engaged with the releasing lever 22 and the connector holder 19. On the carriage 1, there is further provided a locking pawl 24 and a locking spring 25 constituting the locking means. The locking means, as will be described hereinafter, normally locks the releasing lever 22 at the recording head positioning state. It limits the operation of the releasing lever 22 so as to permit rotation thereof to the releasing position, when the carriage 1 is abutted to a guide 27 of a casing 26 of the apparatus, that is, when the carriage 1 is at the carriage rest position (or capping position) A.

When the carriage 1 is at the rest position A, the ink ejecting parts of the recording heads 2 are capped by the capping means 8. The capping means 8 are each provided with capping portion 28A, 28B, 28C or 28D capable of hermetically closing the ink ejecting parts of the recording heads 2.

The apparatus casing 26 is provided with a carriage locking portion 29 which is disposed between the releasing lever 22 and the carriage 1 when it is at the rest position A. The carriage locking portion 29, as will be described hereinafter, is sandwiched between a side surface of the carriage 1 and an engaging portion 31 of the releasing lever 22 to stop movement of the carriage when the releasing lever 22 is rotated to the recording head releasing position under the condition that the carriage 1 is at the rest position A. Therefore, it constitutes a carriage movement preventing means.

Figure 3:
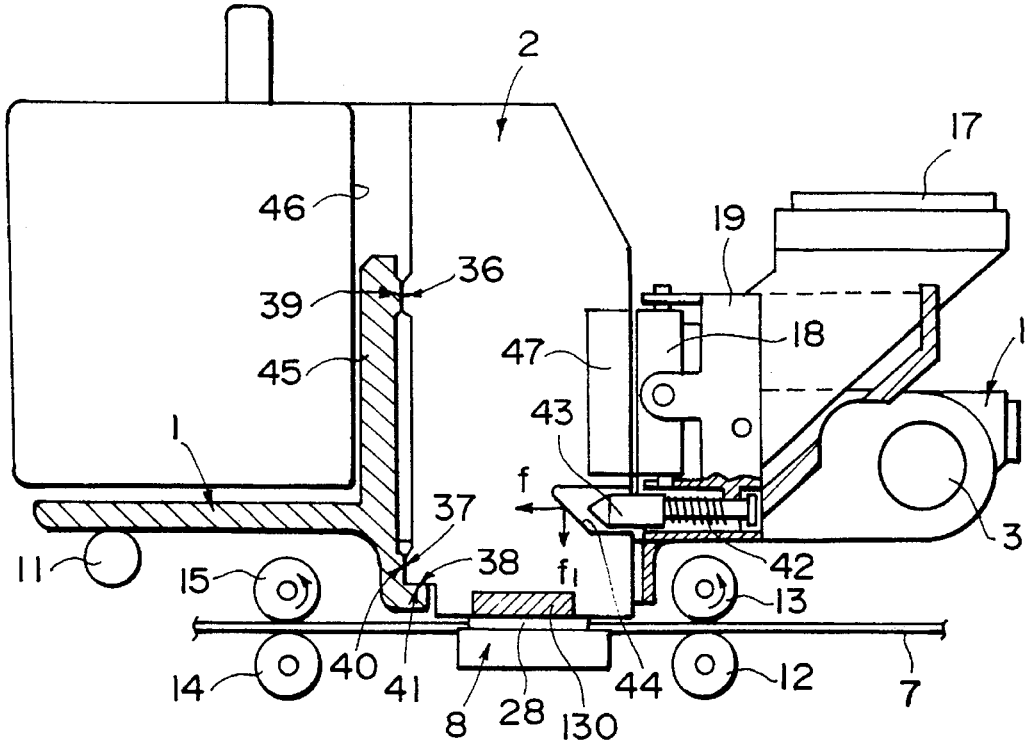
FIG. 3 is a side view of the recording apparatus illustrating loading of the recording head.

FIG. 3 is a side sectional view of a carriage 1 and a recording part in FIG. 2.

In FIG. 3, the recording head 2 is mounted at the correct position by the abutment between abutment surfaces 36, 37 and 38 of the recording head 2 and abutment surfaces 39, 40 and 41 of the carriage 1.

More particularly, by pushing pin 43 mounted in the connector holder 19 and urged in the projecting direction by a spring 42, the recording head 2 is urged in the leftward detection in FIG. 3, by which the abutting surfaces 36 and 37 are urged to the abutment surfaces 39 and 40. Therefore, the head cartridge 2 is positioned in the horizontal direction relative to the carriage. By a downward component $f_1$ of force f urging the slanted surfaces 44 of the recording head 2 by an end of the urging pin 43, the abutment surface 38 of the recording head 2 is urged to the abutment surface 41 of the carriage 1, so that the recording head 2 is positioned in the height direction.

The connector holder 19 is mounted to the connector 18.

The perpendicular surface 45 of the carriage 1 and the perpendicular surface 46 of the recording head 2 function as rough guides when the recording head is mounted on the carriage. The ink ejecting part (ejection part) 130 of the recording head 2 is in contact with the capping portion 28 of the capping means 8 to cover the ink ejector (or ink ejecting surface 131 shown in FIG. 4A), when the carriage 1 is at a predetermined position.

Figures 4, 4A:
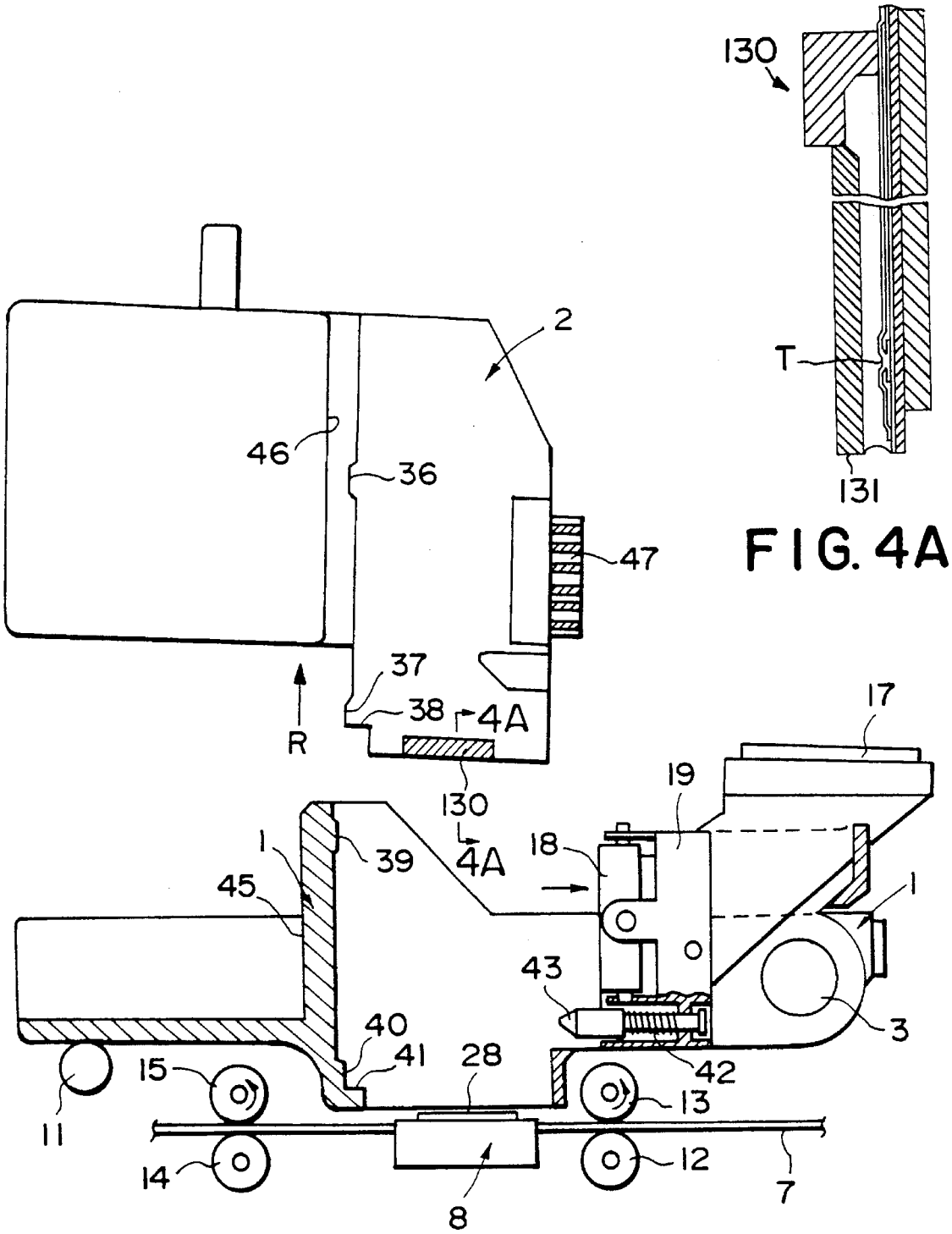
FIG. 4 is a side view of the recording apparatus illustrating the dismounting action of the recording head and FIG. 4A is a section taken along line 4A—4A in FIG. 4.

FIG. 4 is a side sectional view when the recording head 2 is dismounted from the carriage 1. The sectional view in FIG. 4A schematically depicts the ink ejecting part 130 of the recording head, showing an electro-thermal transducer T and the ink ejecting surface 131. In FIG. 4, when the recording head 2 is dismounted, the connector holder 19 is first moved toward the right by a mechanism which will be described hereinafter in conjunction with FIG. 5. When the connector holder 19 is moved, the movement of the recording head 2 is prevented by the abutments of the rough guides 45 and 46, and therefore, the connector 18 is separated from the head connector 47, and simultaneously, the pushing pin 43 is away from the recording head 2. Therefore, the recording head 2 is released from the positioned state.

When the connection between the head connector 47 and the connector 18 is released, and the pushing pin 43 is separated from the recording head 2, the recording head is now detachable in the direction R.

Figure 5:
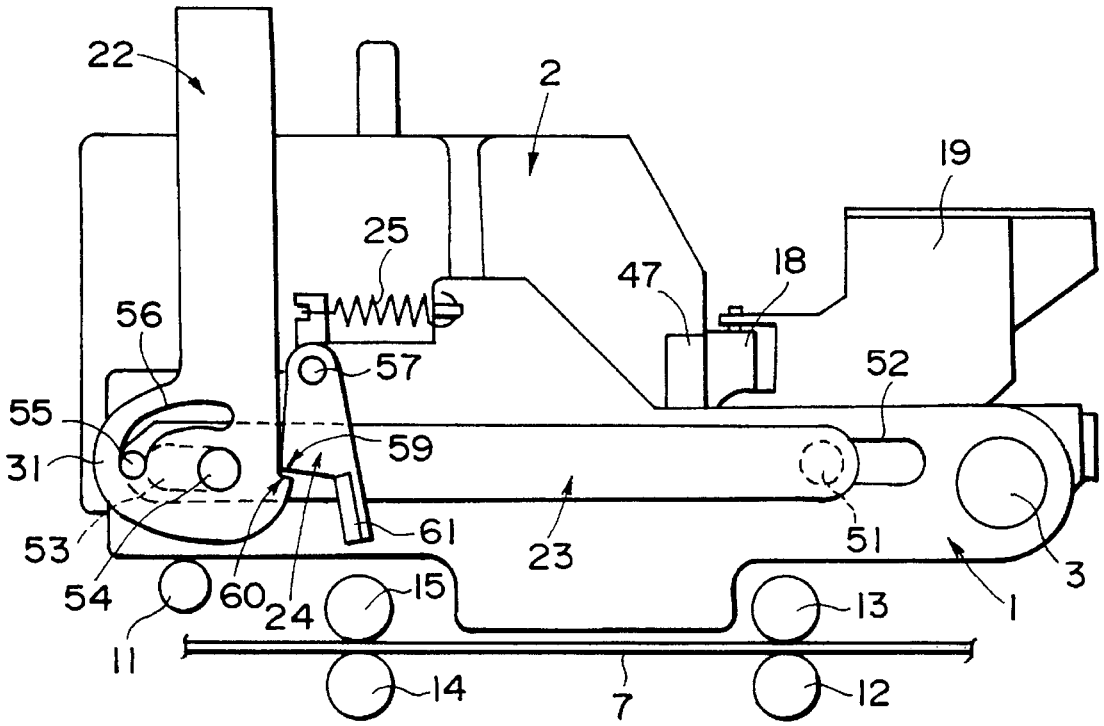
FIG. 5 is a side view of the recording apparatus illustrating the locked state of the recording head mounting mechanism.

FIG. 5 is a side view illustrating a mechanism for moving the connector holder 19, and simultaneously it illustrates a mechanism for locking the releasing lever 22.

In FIG. 5, a shaft 51 of the connector holder 19 is integrally coupled with a link plate 23. The shaft 51 is engaged with a sliding hole 52 formed in the carriage 1, and the link plate 23 is provided with a sliding hole 53 which is engaged with a carriage shaft 54 of a carriage 1. Therefore, the connector holder 19 and the link plate 23 are slidable toward the front and rear relative to the carriage 1.

The releasing lever 22 is rotatable about the carriage shaft 54, and a projection 55 of the link plate 23 is engaged with a cam slot 56 formed in the releasing lever 22. Therefore, together with the rotation of the releasing lever 22, the link plate 23 moves toward right and left relative to the carriage 1. The locking pawl 24 is rotatable about a locking shaft 57 of the carriage 1, and is urged in the clockwise direction in FIG. 5 by a locking spring 25 stretched between itself and the carriage 1. Therefore, as shown in FIG. 5, in the normal recording operation, the engagement between the locking portion 59 formed in the locking pawl 24 and the locking portion 60 formed in the releasing lever 22 prevents the rotation of the releasing lever 22.

Figure 6:
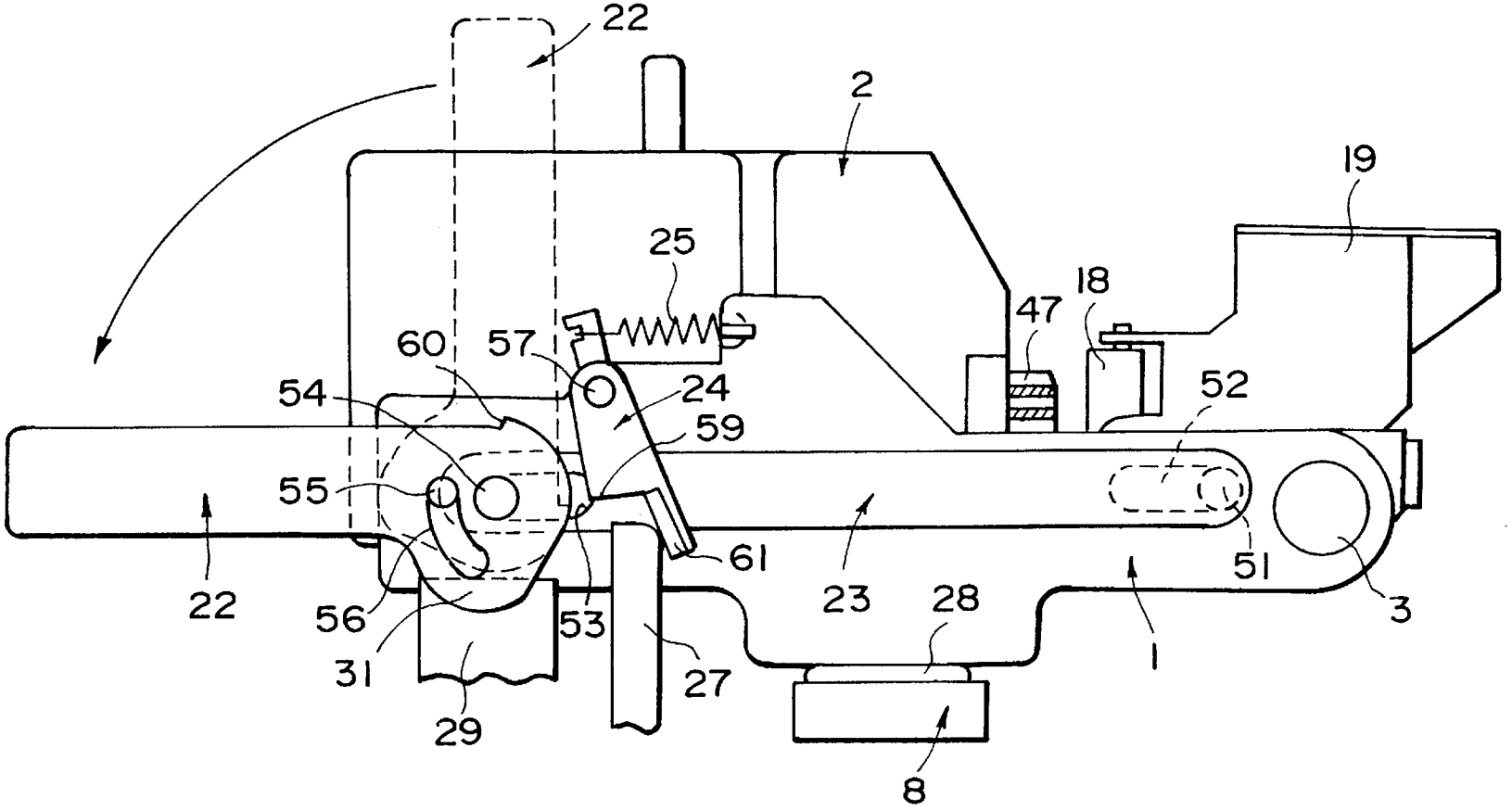
FIG. 6 is a side view of the recording apparatus illustrating the released state of the recording head mounting mechanism and the locked state of a carriage movement preventing means.

FIG. 6 is a side view of the releasing lever 22 in the releasing state. When the carriage 1 moves to the carriage rest position A (FIG. 1), the guiding surface 61 of the locking pawl 24 on the carriage abuts the guiding portion 27 (FIG. 1) of the casing 26, and the locking pawl 24 is rotated along the slanted surface in the counterclockwise direction in FIG. 6 against the locking spring 25.

When the locking pawl 24 is rotated in this manner, as shown in FIG. 6, the locking portion 59 of the locking pawl 24 is released from the locking portion 60 of the releasing lever 22, so that the engagement therebetween is released, thus permitting rotation of the releasing lever 22.

In FIG. 6, the releasing lever 22 is shown by solid lines when it is rotated to a releasing position permitting dismounting of the recording head 2, and the releasing lever 22 is shown by broken lines when it is in the position for locking (positioning) the recording head 2.

When the releasing lever 22 is rotated from the locking position to the releasing position, the camming action of the projection 55 and the cam hole 56 urges the connector holder 19 integral with the link plate 23 away from the head connector 47 of the recording head 2 (to the right in FIG. 6).

When the connector holder 19 moves toward the rear (to the right in FIG. 6), the connector 18 is moved away from the head connector 47, and the pushing pin 43 (FIG. 3) is away from the recording head 2, so that the recording head 2 is brought into the released state.

Therefore, the releasing operation of the releasing lever for the cartridge is made possible only when the recording head is at the non-recording (capping) position, and therefore, the recording head is prevented from being replaced at the recording position even when the jam occurs. Accordingly, the inadvertent contact between the recording material and the recording head is prevented, and therefore, the damage of the recording head resulting from the contact can be avoided. In addition, the ink is prevented from scattering in the apparatus.

The lock releasing mechanism has been described as of a mechanical type using the scanning motion of the carriage, but it may be replaced with electrically controllable means. An example thereof is shown in FIG. 7.

Figure 7:
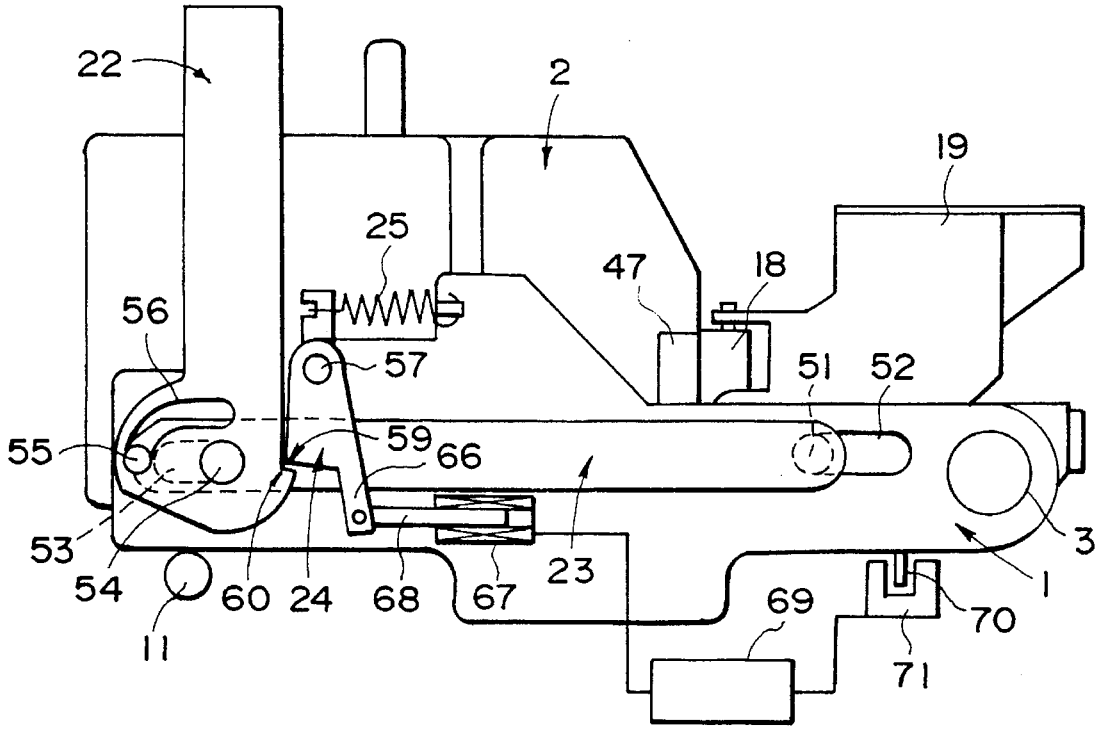
FIG. 7 is a side view of a locking member of a recording head mounting mechanism of another example.

In FIG. 7, an arm portion 66 of the locking pawl 24 is connected with a solenoid shaft 68 of a solenoid mounted on the carriage 1. The ON-OFF of the solenoid 67, that is, the lock releasing motion of the releasing lever 22 is controlled by an electric control circuit 69. The carriage 1 is provided with a position detector 70, so that a photosensor 71 disposed at the apparatus casing side detects whether the carriage is at the predetermined position.

The signal from the photosensor 71 is supplied to the electric circuit 69. When the cartridge mounting carriage is at the capping position, the solenoid 67 is actuated by the control of the electric control circuit, and the locking pawl 24 is rotated in the clockwise direction in FIG. 7. Similarly to the foregoing embodiment, the locking of the releasing lever 22 is released.

If the releasing lever 22 is simply rotated to the releasing position, the carriage 1 is still movable to the recording region. Therefore, although the dismounting of the recording head is possible only at the capping position, the mounting of the recording head is possible when the carriage is in the recording region. Therefore, the safety in the mounting of the recording head (damage of the head or the scattering of the ink in the apparatus) is not perfectly complete. From this standpoint, the apparatus of this embodiment is provided with a carriage lock 29 (FIGS. 2 and 6) engageable with the engaging portion 31 of the releasing lever 22 at the capping position when the lever is in the released state. This prevents the carriage 1 from moving from the capping position in the scanning direction.

In the shown example, when the carriage 1 is at the rest position A, the locking portion 29 of the carriage enters the clearance between a side surface of the carriage 1 and the engaging portion 31 of the releasing lever 22. Accordingly, by rotating the releasing lever 22 to the released position, the carriage locking portion 29 is interposed between the carriage 1 and the engaging portion 31, so that the movement of the carriage 1 in the scanning direction is prevented.

In this manner, the recording head 2 can be mounted or dismounted only when the carriage 1 is at the rest position A. By the dismounting of the recording head 2, the movement for preventing movement of the carriage 1 in the scanning direction is actuated.

According to the embodiment described in the foregoing relating to an ink jet recording apparatus using a detachable recording head 2, when the carriage 1 is at a position other than a rest position A (typically the capping position), the mounting and dismounting mechanism of the recording head 2 on the carriage is locked. Only when the carriage 1 is at the rest position, is the mechanism of the recording head 2 releasable. In interrelation with the mounting or dismounting operation of the recording head 2, the carriage movement preventing means is actuated to prevent movement of the carriage. Therefore, the damage of the .recording head attributable to the inadvertent contact thereof with the recording material 7 or the like, can be prevented. In addition, the scattering of the ink attributable to vibration in the mounting or dismounting operation of the recording head 2, can be prevented. Furthermore, the capping of the recording head 2 at the predetermined position is assured, so that the evaporation of the ink can be prevented.

An electrically controllable image may replace the mechanical means (carriage lock 29 and engaging portion 31) to prevent movement of the carriage in the scanning direction from the rest position (capping position).

Figure 8:
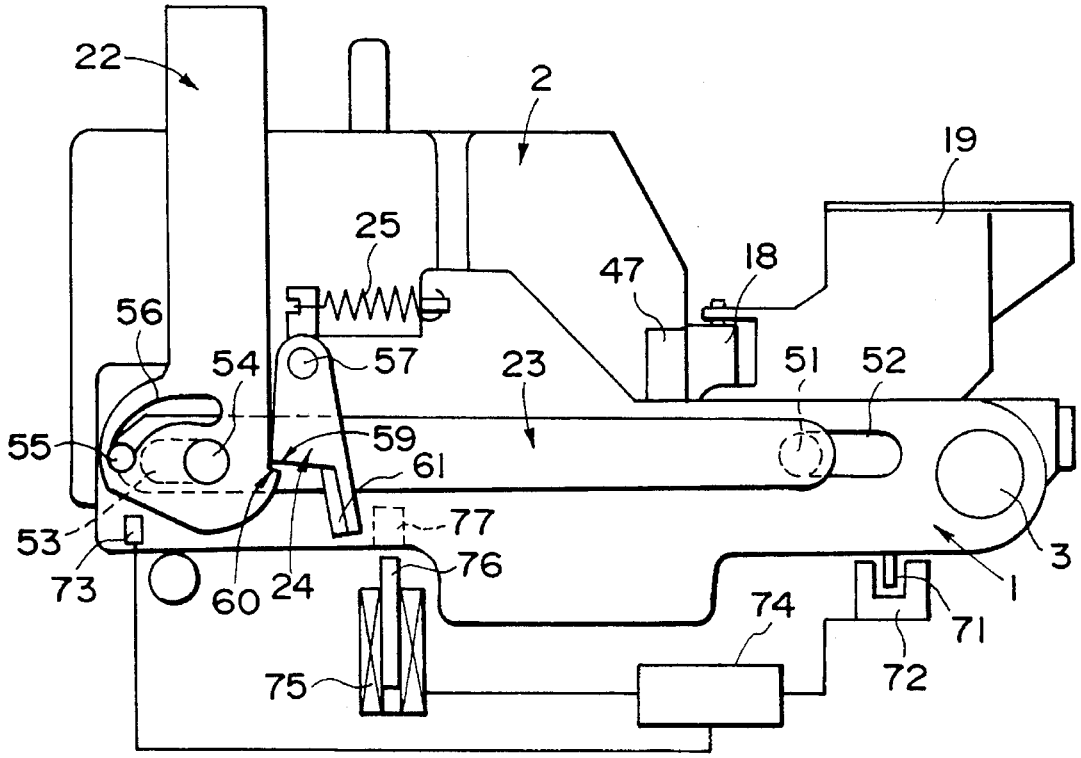
FIG. 8 is a side view of a carriage movement preventing means of another example.

In FIG. 8, the carriage 1 is provided with a position detector 71, to detect by a photosensor 72 whether the carriage is at the predetermined position or not. The releasing lever 22 is provided with a releasing lever sensor 73 to detect motion of the releasing lever (locking position and releasing position). When the predetermined position (the rest position A in FIG. 1) of the carriage 1 is detected, and the dismounting operation using the releasing lever 22 is performed (the rotating motion to the releasing position, for example), the solenoid 75 is energized by the control of the electric circuit 74, so that the solenoid shaft (movable shaft) 76 enters the engaging hole 77 of the carriage 1.

The engaging hole 77 of the carriage 1 is formed at a position faced to the solenoid shaft, when the carriage is at the predetermined rest position.

Therefore, the carriage is prevented from movement and retained at the rest position, by projecting the solenoid shaft 76 into the engaging hole 77 by energization of the solenoid 75 when the carriage 1 is at the predetermined position.

Therefore, also by the structure shown in FIG. 8, the ink jet recording apparatus is such that the mounting and dismounting mechanism of the recording head 2 is releasable only when the carriage is at the predetermined rest position, and such that in interrelation with the mounting and dismounting of the recording head 2 at this position, the carriage movement preventing means 76 and 77 are actuated to prevent movement of the carriage.

Accordingly, also in the embodiment of FIG. 8, similarly to the foregoing embodiment, the damage of the recording head 2 due to the inadvertent contact thereof to the recording material 7 or the like, can be prevented. In addition, the scattering of the ink due to the vibration upon the mounting or dismounting operation of the recording head 2 can be prevented. Furthermore, the capping of the recording head 2 at the predetermined position is assured, and therefore, the evaporation of the ink can be prevented.

As described in the foregoing, the damage of the recording head or the scattering of the ink can be prevented by limiting the mounting and dismounting of the recording head at the rest position A (capping position or non-recording position) by means of the locking mechanism for the releasing lever or by preventing the carriage scanning movement in relation with the rotation of the releasing lever to prevent movement of the carriage during the recording head replacing operation. However, the ink ejecting side of the recording head is more effectively prevented from being damaged.

Figure 9:
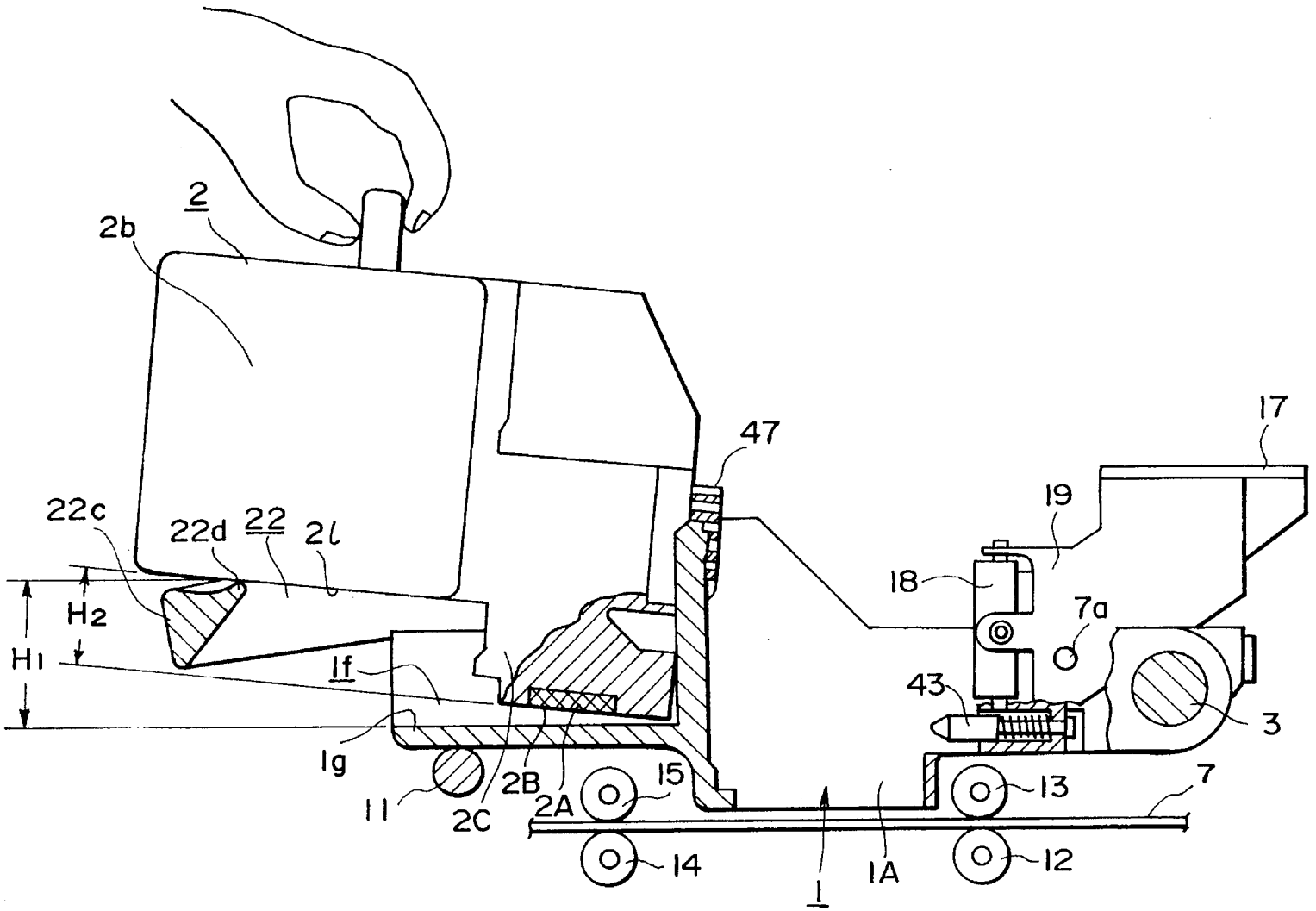
FIG. 9 is a side view of another example of a recording head mounting mechanism.

In FIG. 9, the releasing lever of the mounting and dismounting mechanism, is stopped at a position shown in this Figure, when it is in the released state, so that an inside edge 22*d* of a gripping portion 22*c* constitutes a guide for guiding a head guiding surface 2*l* of the ink jet recording head 2. The inside edge 22*d* is stopped at a position of height H1 from the carriage guiding surface 1*g* in the direction perpendicular to the carriage guiding surface 1*g*. The height H1 is larger than a height H2 from an ink ejection side surface 2B of the recording head portion 2A of the head 2 to the ink jet head guiding surface 2*l*. The rotational radius of the inside edge 22*d* of the gripping portion 22*c* of the releasing lever 22 is selected to be as short as possible so as not to interfere the ink container 2*b* during its rotation, by which when the releasing lever 22 stops at the releasing position, the inside edge 22*d* is stopped at a position as close as possible to an inserting portion 1*a*.

When the mounting and dismounting mechanism is released, and a projection 2C on which the recording head portion 2A of the recording head 2 is mounted is inserted into the inserting portion 1*a* of the carriage 1 or when it is taken out therefrom, the inside edge 22*d* and the ink jet head guiding surface 2*l* are abutted to each other (because of the height relations between H1 and H2), and the bottom surface of the projection 1*a* is inclined relative to the carriage guiding surface 1*g* within the range in which the carriage guiding surface 1*g* and a right end of the bottom surface of the projection 1*a* are contacted. Therefore, the ejection side surface 2B of the recording head portion 2A is prevented from being brought into complete surface contact with the carriage guiding surface 1*g*. In this manner, the sliding between the ejection side surface 2B and the carriage guiding surface 1*g* can be prevented, so that the ejection outlets formed in the ejection side surface 2B can be prevented.

In addition, the grip 22*c* of the releasing lever 22 for actuating the mounting and dismounting mechanism is used as a guide for guiding the guiding surface 2*l* of the ink jet head, and therefore, the ejection outlet formed in the ejection side surface 2*b* can be protected without increase of the manufacturing cost.

A description will now be made as to a further embodiment.

Figure 10:
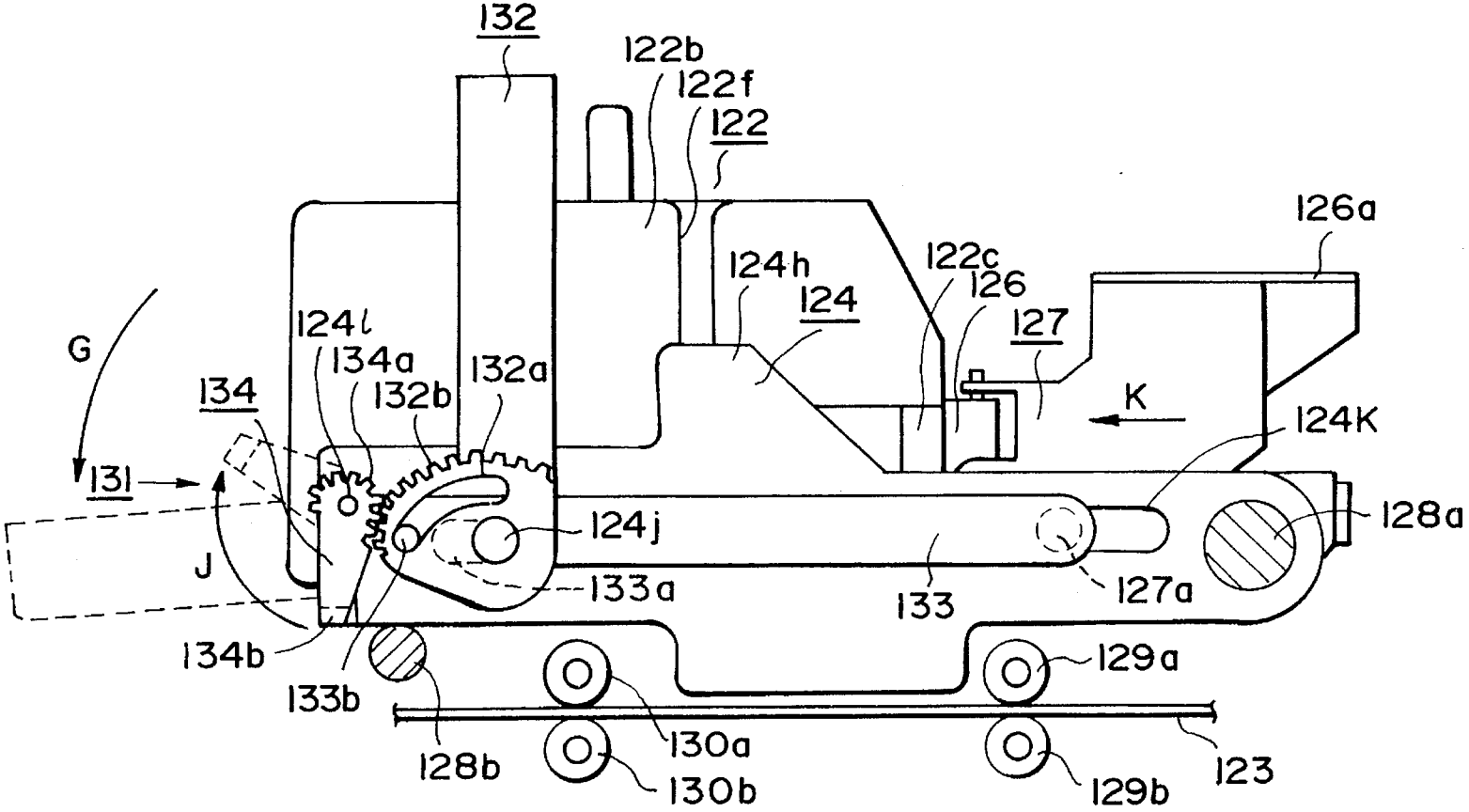
FIG. 10 is a side view of a further example of a recording head mounting mechanism.
Figure 11:
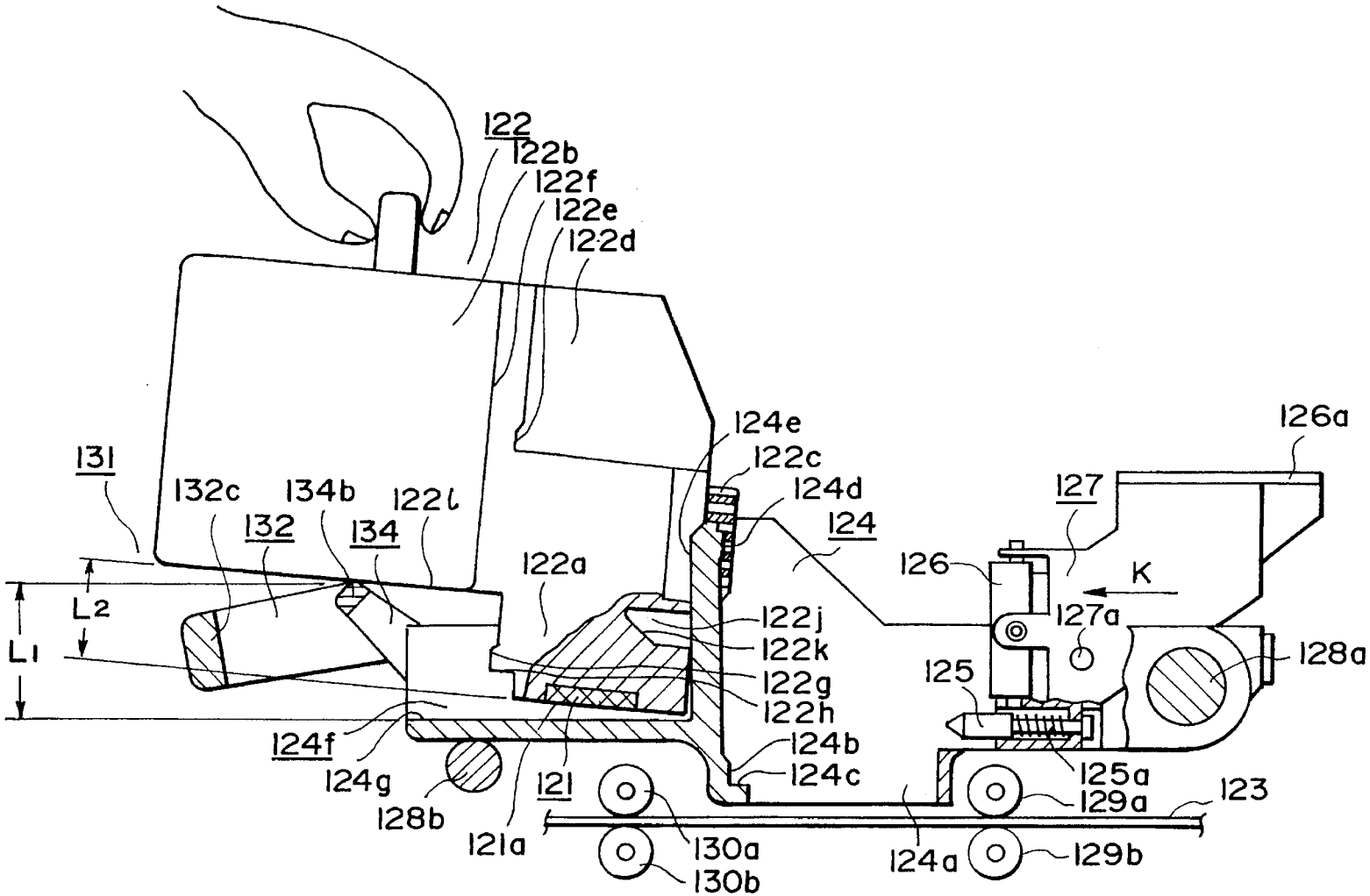
FIG. 11 is a sectional view of a part of the structure shown in FIG. 10.

As shown in FIGS. 10 and 11, the mounting and dismounting mechanism 131 of this embodiment is provided with a guide arm 134 which has a channel-like shape. The ends thereof are supported on a rotational shaft 124*l* projected from a side surface 124*h* of the carriage 124 and another rotational shaft (not shown) projected from an unshown side surface opposite from the side surface 124*h*, for rotation in the direction J and the opposite direction, respectively. At an end of the guide arm 134, an arm gear 134*a* is formed and is meshed with a lever gear 132*b* formed on the releasing lever 132.

When the releasing lever 132 is at the shown fixed position, the arm guiding portion 134*b* of the guide arm 134 is disposed below a container portion 122*b* of the ink jet recording head 122. When the releasing lever 132 is rotated from the fixed position to the releasing position indicated by the broken lines in the direction G, the guide arm 134 rotates in the direction J with the rotation of the releasing lever 132 because of the meshing engagement between the lever gear 132*b* and the arm gear 134*a*, until the guide arm 134 stops at the position indicated by the broken lines.

As shown in FIG. 11, the guide arm 134 stops at the position indicated when the mounting and dismounting mechanism 131 takes the releasing position. The arm guide 134*b* constitutes a guide for guiding the ink jet head guide surface 122*l* of the ink jet head 122. The arm guide 134*b* stops at a position which is at a height of L1 from a carriage guiding surface 124*g* from the carriage guiding surface 124*g* in the direction perpendicular to the guiding surface 124*g*. The height L1 is larger than a height L2 from an ejection side surface 121*a* of the recording head portion 21 of the ink jet head 122 to the ink jet head guiding surface 122*l*. In the releasing state, the arm guiding portion 134*b* rotates to a position as close as possible to the container portion 122*b* of the ink jet head 122 mounted on the carriage 124, and stops there.

When the ink jet head 122 is mounted on or demounted from the carriage 124 with the mounting and dismounting mechanism 131 in the releasing state, the arm guide 134*b* (guide portion) and the ink jet head guiding surface 122*l* are abutted to each other, and the ejection side surface 121*a* of the recording head 121 is prevented from complete surface contact with the carriage guiding surface 124*g*, similarly to the embodiment of FIG. 9, within the range in which the carriage guiding surface 124*g* is in contact with the right (in the Figure) end of the bottom surface of the projection 122*a*. Therefore, the friction between the ejection side surface 121*a* and the carriage guiding surface 124*g* can be prevented, so that the ejection side surfaces 121*a* and the ejection outlets can be protected.

A further embodiment will be described. In the ink jet recording head 2 described in conjunction with FIG. 9, the container 2*b* for containing the ink to be supplied to the recording head portion 2A is integral with the recording head portion 2A. In the present embodiment which will be described, the ink jet recording head does not have such an integral container portion as shown in FIG. 9. Instead, the container for containing the ink to be supplied to the recording head portion of the ink jet head is provided in the main assembly of the ink jet recording apparatus.

Figure 12:
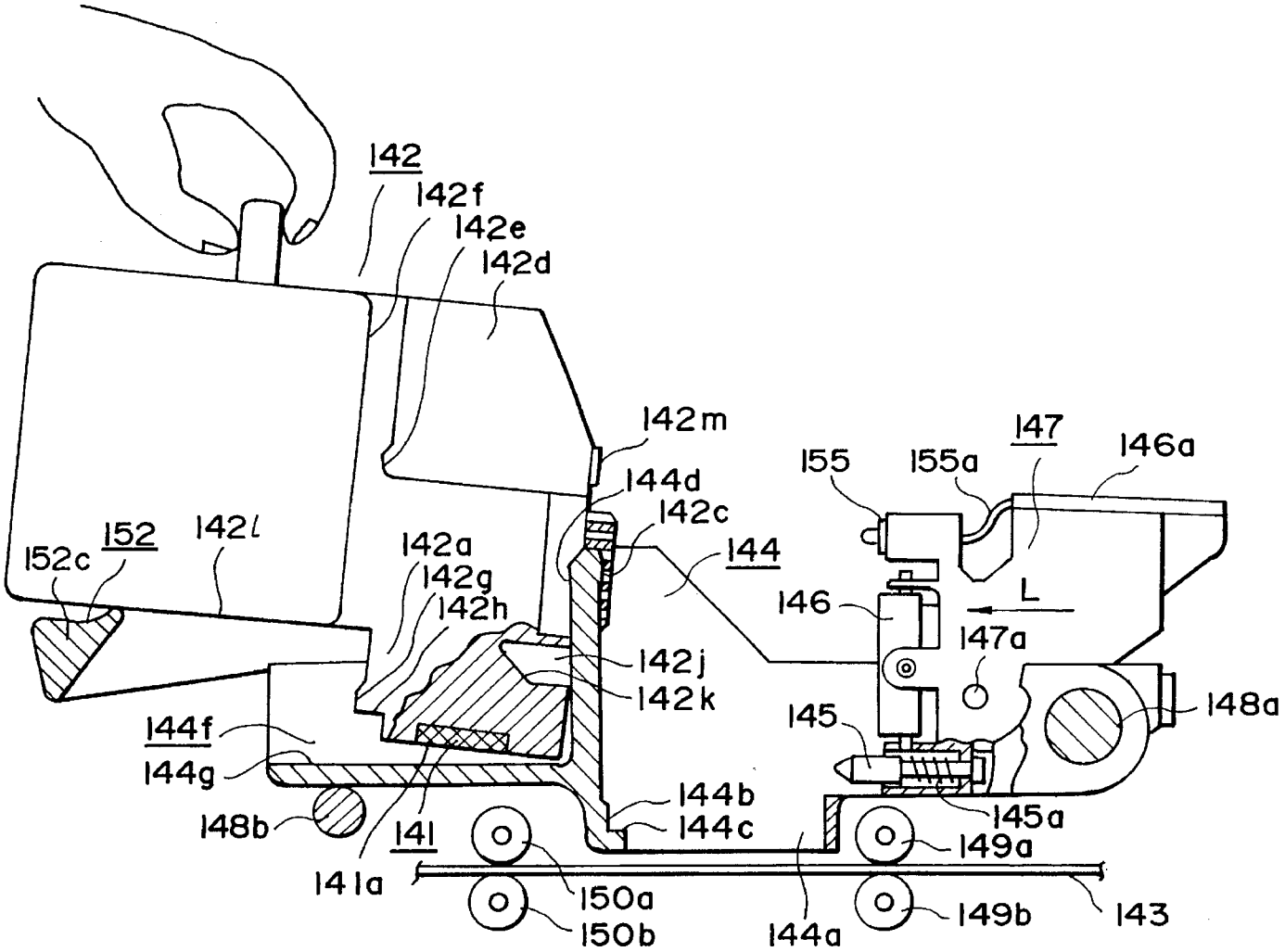
FIG. 12 is a side view of an example of an ink supply mechanism for the recording head using the recording head mounting mechanism.

Referring to FIG. 12, a connector holder 147 of the carriage 144 is provided with a coupler 155. The coupler 155 is connected with a tube 155*a* communicating with the container (not shown) for containing the ink to be supplied to the recording head portion 141 of the ink jet head 142. On the other hand, the ink jet head 142 is provided with a head coupler 142*m* at a position corresponding to the main assembly coupler 155. The head coupler 142*m* is in communication with the recording head portion 141 through an ink supply path, not shown.

A projection 142*a* of the ink jet head 142 is inserted into a receptor 144*a* of the carriage 144, and the releasing lever 152 of the mounting and demounting mechanism is rotated to the fixed position and is stopped there, the connector holder 147 moves in the direction L, upon which the main assembly coupler 155 and the head coupler 142*m* are coupled with each other. The ink contained in the container is supplied to the recording head portion 141 through the tube 155*a*, the main assembly coupler 155, the head coupler 142*m* and the ink supply passage in the order named.

In place of the mounting and demounting mechanism of this embodiment, the mechanism having the guide arm described in conjunction with FIGS. 10 and 11 may be used for the carriage 144.

Since the embodiment has the structure described above, the following advantageous effects are provided.

When the mounting and demounting mechanism is released to permit mounting of the ink jet head on the carriage, the guiding portion for guiding the ink jet head guiding surface of the ink jet head is provided at such a position as to incline the ejection side surface of the ink jet head relative to the carriage guiding surface. This is effective to prevent the ejection side surface from being in complete surface contact with the carriage guiding surface in the range wherein the guiding portion guides the ink jet head guiding surface, and therefore, to prevent the sliding contact between the ejection side surface and the carriage guiding surface. As a result, the ejection side surface and the ejection outlets can be protected with the simple structure. Therefore, the probability that the ejection outlets are clogged with the foreign matter on the carriage guiding surface, can be avoided, and in addition, the possibility that the water repelling coating layer on the ejection side surface is scraped, can be avoided.

Additionally, a grip of the releasing lever for operating the mounting and demounting mechanism is utilized as a guide for guiding the ink jet head guiding surface, and therefore, the increase of the manufacturing cost is not caused.

Figure 13:
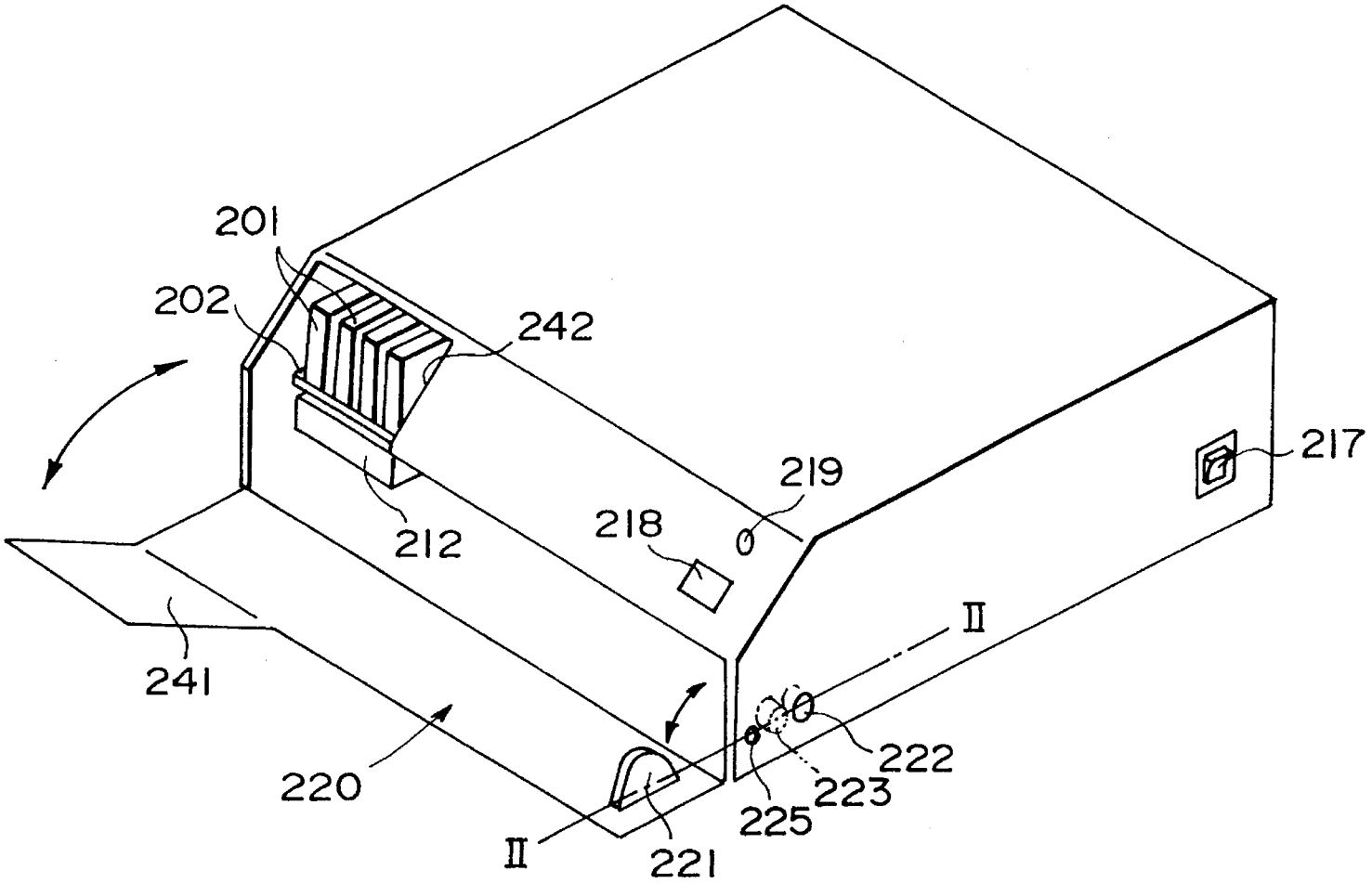
FIG. 13 is a perspective view of an example of a recording apparatus using the present invention.

In FIG. 13, an openable door (front door) 220 is provided at a front part of the ink jet recording apparatus.

The door 220 is provided with a projection 241, and the main assembly of the recording apparatus has a cut-away portion (opening) 242 opened and closed by the projection 241. The cut-away portion 242 is effective to make the replacement of the recording head portion 1A–1D (recording head 1) at the capping position easy.

At the backside of the door 220, a locking member 221 constituting a locking means for cooperating with the locking mechanism of the main assembly of the apparatus to limit the opening and closing of the door, is projected.

The locking means functions to prevent the door 220 from changing from an open state or closed state (current state) to another state. The locking means, as will be described hereinafter, is effective to prevent the operator from freely opening and closing the door 220 when the door 220 is closed. When for example, the main switch is actuated, the door 220 is freely openable or closable, but when the main switch is not actuated, the door 220 is not openable or closable.

Figure 14A:
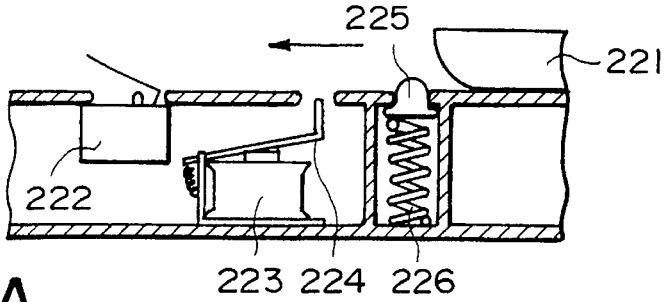
FIGS. 14A–14E comprise sectional views of an example of a door locking mechanism.
Figure 14B:
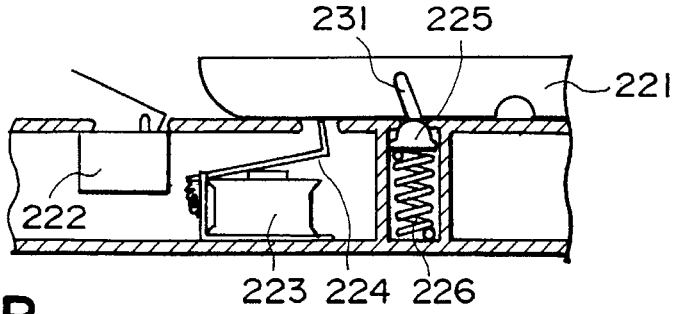
Figure 14C:
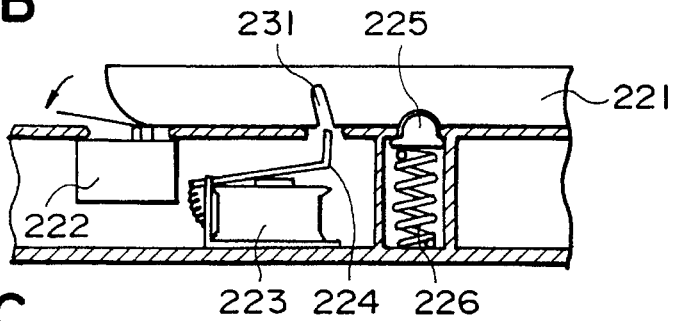

FIGS. 14A, 14B and 14C are sectional plan views taken along a line II—II of FIG. 13 to illustrate structure and operation of the locking means. FIGS. 14A, 14B and 14C illustrate the actions when the door 220 is moved from the open state to the closed state, when the main switch of the main assembly of the apparatus is on. When the main switch is on, the solenoid 223 attracts the movable iron member 224 by the signal from a controller, so that it is in the locking state.

With the closing motion of the door 220, the locking member 221 moves in the direction indicated by an arrow along the locking means. As shown in FIGS. 14A and 14B, the locking member 221 depresses a projection 225 urged by the spring 226 while moving therealong, until it reaches the closing position of FIG. 14C. At this closing position, the projection 225 is projected into the recess of the locking member 221 by the spring 226, so that the door 220 is completely closed. In addition, with this state, the locking member 221 depresses the door sensor 222, upon which a controller of the apparatus main assembly detects the closing of the door 220. Since the main switch is actuated, the solenoid 223 continues to keep the member 224 attracted, even in the state of FIG. 14, so that the door 220 is freely movable. Thus, as long as the main switch is in on-state, the door 220 can be freely opened or closed.

Figure 14D:
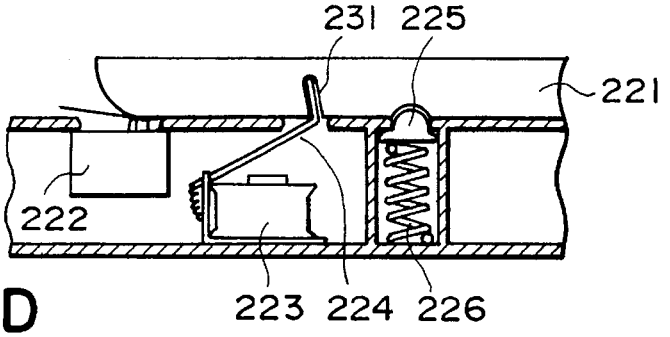

After the door 220 is completely closed, and the main switch is rendered off, the solenoid 223 is deenergized to release the movable iron member 224. This is shown in FIG. 14D. The released member 224 projects outward by the urging force of the spring, by which a pawl portion of the movable member enters the engaging hole 231 of the locking member 221, and therefore, the locking member 221 is locked so as to prevent opening and closing of the door.

Figure 14E:
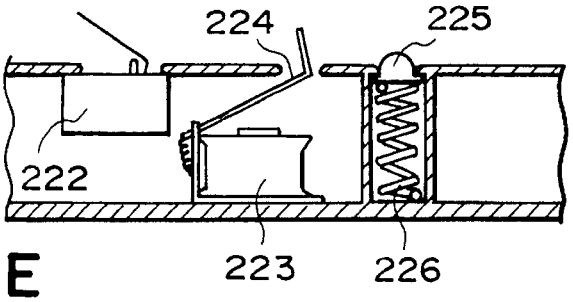

When the main switch is rendered off when the door 220 is opened with the main switch actuated, the movable member 224 projects to prevent movement of the locking member 221, as shown in FIG. 14E, and therefore, the door 220 is prevented from closing. Thus, in this embodiment, the door 220 is openable or closable only when the main switch is in the on-state.

Figure 15:
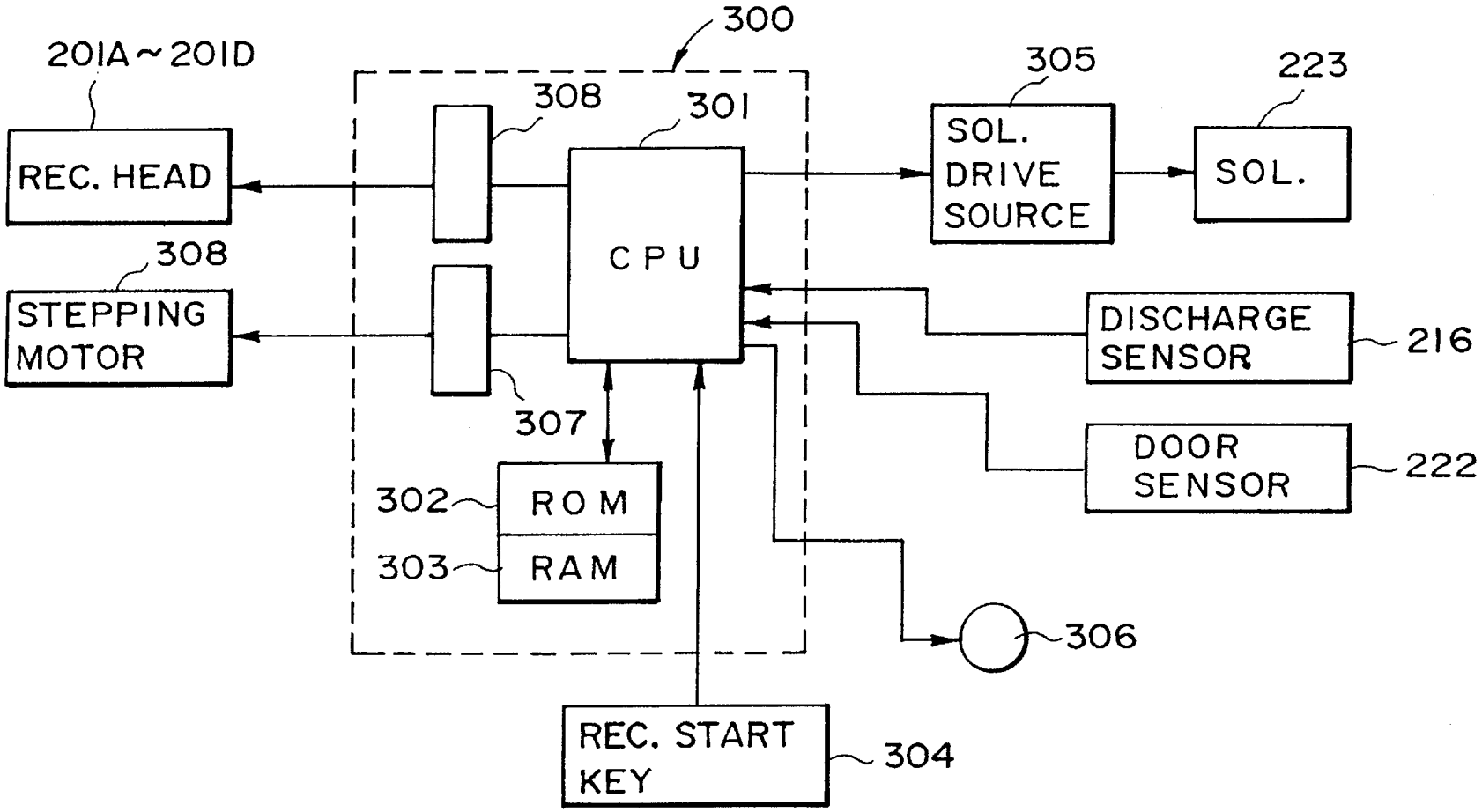
FIG. 15 shows an example of a control circuit according to an embodiment of the present invention.

FIG. 15 is a block diagram of the entire system of the recording apparatus of this embodiment. The system comprises a controller 300 for controlling the entirety of the recording apparatus. The controller 300 comprises a CPU 301 in the form of a microprocessor or the like, a ROM 302 storing various data and CPU control program which will be described in conjunction with FIGS. 16, 17, 18 and 19, and a RAM 303 usable as a work area for the CPU 301 and used for a temporary storing of various data.

The CPU 301 receives a record starting signal from a record starting key 304, a door closure detection signal from the door sensor 222, a sheet discharge signal from the sheet discharge sensor 216, or the like.

On the other hand, the CPU 301 is responsive to the input signals to control various portions and is also effective to perform the image recording operation in accordance with image signals from the cost apparatus or the like.

The CPU 301 produces solenoid control signals in response to the detection signals or the like to control the solenoid driving source 305, so that the operation of the solenoid 223 is controlled.

When the CPU 301 discriminates paper jam on the basis of detection signals from the discharge sensor 216 or the like, it turns the sheet jam lamp 306 (display) on.

In the recording operation, the CPU 301 controls the motor driver 307 to control the motor such as carriage moving motor 308, and also controls operation of the recording heads 201A–201D by controlling the recording head driver 308 in accordance with the image signals from the host apparatus or the like.

Figure 16:
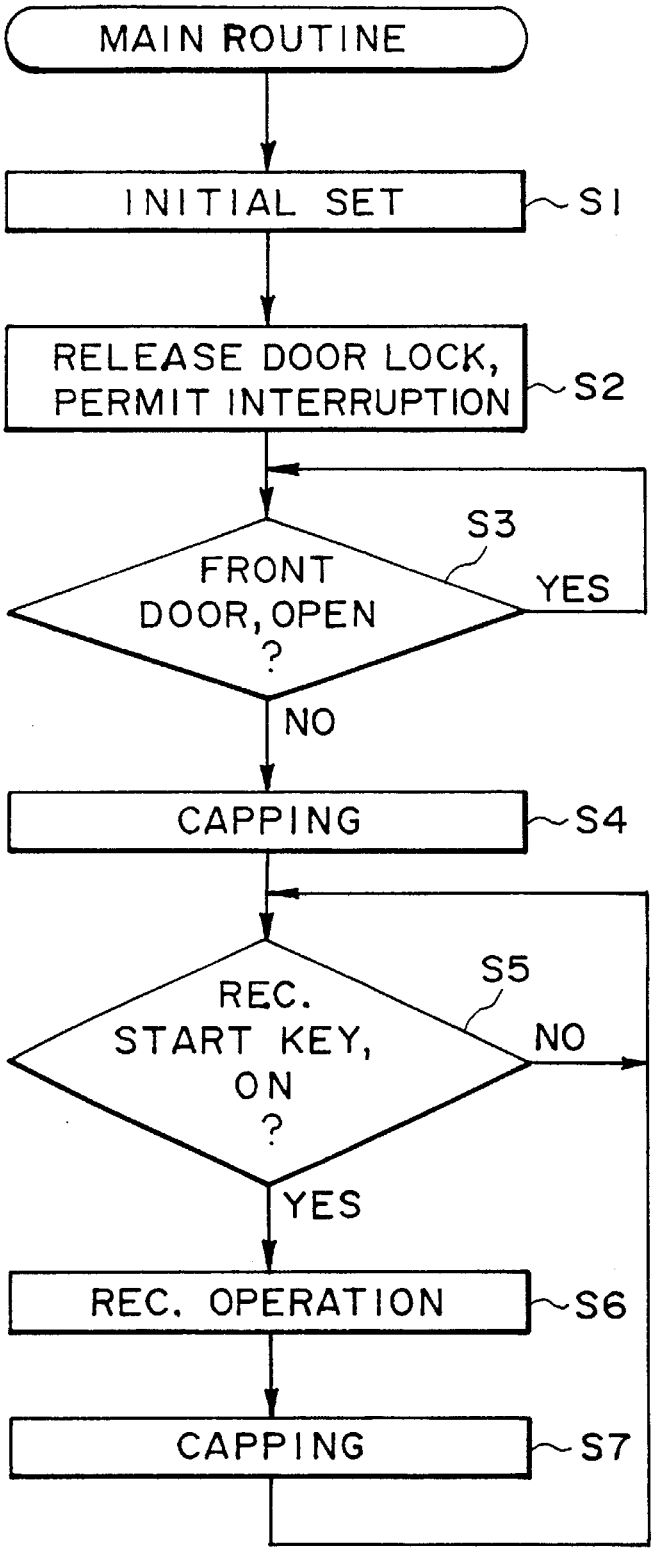

FIGS. 16 and 17 are flow charts illustrating the main routine and interruption routine of the control operation of the ink jet recording apparatus described in the foregoing.

In FIG. 16, when the main switch of the recording apparatus is actuated, the initial setting is performed for the CPU and the RAM or the like of the controller (not shown) at step S1. After the initial setting is completed, the locking for the door 220 is released to permit interruption at step S2. A particularly, the solenoid 223 is energized to attract the movable iron piece 224 to retract the pawl portion of the movable piece 224 from the engaging hole 231 of the locking member 221, thus releasing it. Then, the operator is permitted to open the door 220.

At step S3, the opening of the door 220 is detected by the door sensor 222. If the door 220 is opened, the recording operation is not started, and the checking operation is continued in the closed loop until the door is closed.

When the door 220 is closed, the recording head 201 is capped with the capping means 212 at step S4. After the capping, the depression of the starting key by the operator is awaited at step S5.

When the record start key is depressed, the recording operation is started at step S6. After the completion of the recording operations for a predetermined number of sheets, the recording head 201 is capped at step S7. After the capping, the operation returns to step S5 so as to prepare for the next recording operation, that is, the next depression of the start key is awaited.

Referring to FIG. 17, the description will be made as to the interruption routine. When the door 220 is opened, and the door sensor 222 detects the event, an interruption request is made to the CPU of the controller. If the operation of the main routine of FIG. 16 is subsequent to the step S3, the interruption is already permitted, and therefore, the operation shifts to the interruption routine shown in FIG. 17.

In FIG. 17, at step S8, the recording operation is stopped on the premise that the door 220 is opened during the recording operation. More particularly, the driving pulse and the ink ejection pulse to the recording head 201 is stopped. In addition, the driving pulse to the stepping motor 308 is stopped to stop the motion of the carriage 202. The record stopping operation does not adversely affect the apparatus even if it is carried out not during the recording operation. At step S9, the step number of the main routine is changed to "3" before returning to the main routine. By the change of the step number, the main routine operation starts at the step S3 immediately after the operation returns to the main routine from the interruption routine.

Because of the above-described interruption processing, the capping operation is always effected after the door 220 is opened or closed.

If the door 220 is opened or closed, the recording material is detected by the sheet discharge sensor 216 in FIG. 15. The sheet jam is discriminated because the sheet exists at the sheet discharge sensor 216 before the record start key is depressed. Therefore, the sheet jam lamp 219 in FIG. 13 is on to prompt the operator to remove the recording material and to reactuate the main switch.

According to the embodiment described in the foregoing, the situation in which the recording head 201 is left without being capped, occurs only when the main switch is deactuated during the recording or when the door 220 is opened during the recording. Therefore, the recording head 201 is not left without being capped except for the case in which the operator deliberately does it.

Therefore, according to this embodiment, the possibility of the recording head 201 being left without being capped, can be avoided almost completely. Therefore, the solidification of the ink due to operator's inadvertent error can be avoided.

FIG. 18 shows the door locking mechanism and illustrates its operation, according to another embodiment. FIG. 18 is a sectional plan view of the same portion as in FIG. 14.

FIG. 18A shows the state in which the locking member 221 is disposed at the open side when the main switch is not actuated. FIG. 18B shows the state in which the locking member 221 is at the closing position when the main switch is not actuated. FIG. 18C shows the state in which the locking member 221 is in the middle between the open and closed states when the main switch in the on-state.

In these Figures, an engaging member 227 made of iron is rotatably mounted about a pivot 229 on the main assembly of the recording apparatus. The engaging member 227 is urged by a spring so as to project beyond the surface on which the locking member 221 passes, as shown in FIG. 18A.

The engaging member 227 has a stop surface 227A and a slide surface 227B and is capable of preventing the closing movement of the locking member 221, but permits the opening movement thereof, because of its configuration.

On the other hand, the locking member 221 has a configuration corresponding to the projection (pawl) of the engaging member 227. More particularly, the configuration is such as to permit the opening direction movement but prevents the entering direction movement. It also comprises a recess 232 engageable with the engaging member 227 at the close position shown in FIG. 18B.

Adjacent the engaging member 227, a solenoid 230 is disposed. The solenoid 230 is responsive to a signal from the CPU to attract the engaging member 227 against the spring force of the spring 228 to retract it so as not to interfere the locking member 221. Similarly to the foregoing embodiment, a door sensor 222 is provided.

When the door 220 is closed, and the locking member 221 is at the position shown in FIG. 18B, the locking member 221 pushes the door sensor 222 as long as the main switch is in an on-state, and therefore, the CPU discriminates the closure of the door 220.

If on the other hand, as shown in FIG. 18B, when the door 220 is at the closed position, and the main switch is in the on-state, the solenoid 230 is deenergized, so that the engaging member 227 is projected. Therefore, the locking member 232 is at the closing position.

However, when the locking member 221 moves in the opening direction, the locking member 221 is movable to the right since the engaging member 227 is retractable against the spring 228. Therefore, the door 220 is permitted to open. Therefore, the locking member 221 makes the motion from the FIG. 18B state to the FIG. 18A state through the FIG. 18C state. Therefore, the door 220 is opened. When the door 220 is opened, the engaging member 220 is projected beyond the locking member passing surface by the spring 228. This prevents the locking member 221 from moving in the closing direction (to the left). In other words, the door 220 is prevented from being closed.

When the door 220 is closed with the main switch in the on-state, the situation is the same as when the door 220 is opened with the main switch non-actuated, until the door 220 is completely opened.

In the case of the main switch being actuated, when the door sensor 222 is opened, the CPU detects the opening of the door 220, and the energized state of the solenoid 230, to attract the engaging member 227, is maintained until the door sensor is depressed by the closure of the door 220.

Therefore, when the main switch is in the on-state, and the door 220 closed, the door 220 is can be opened and reclosed.

In the above-described manner of control, the door 220 can be closed only when the main switch is in the on-state, in the present invention, too.

Figure 19:
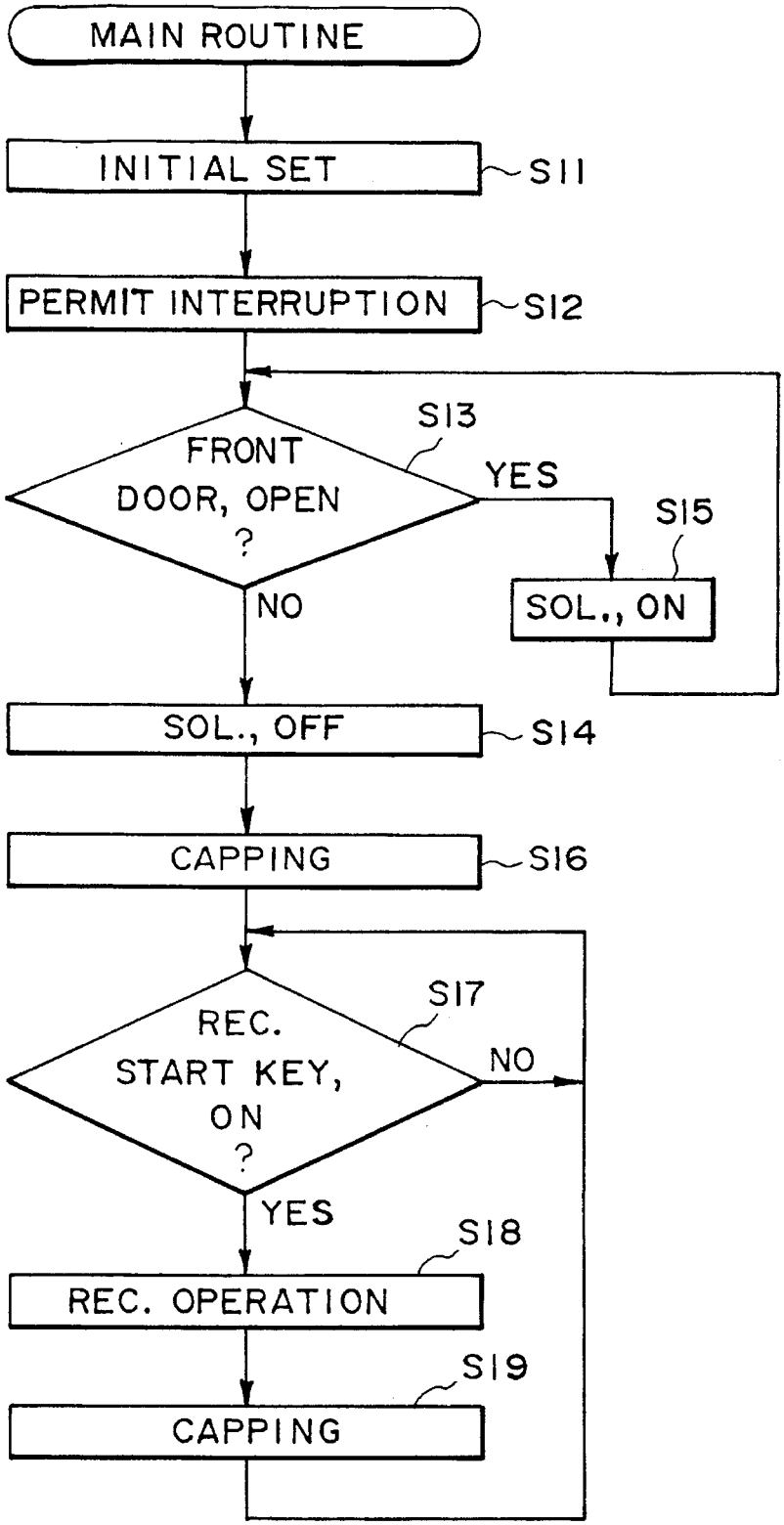
FIGS. 19 and 20 are flow charts illustrating another example of control.
Figure 20:
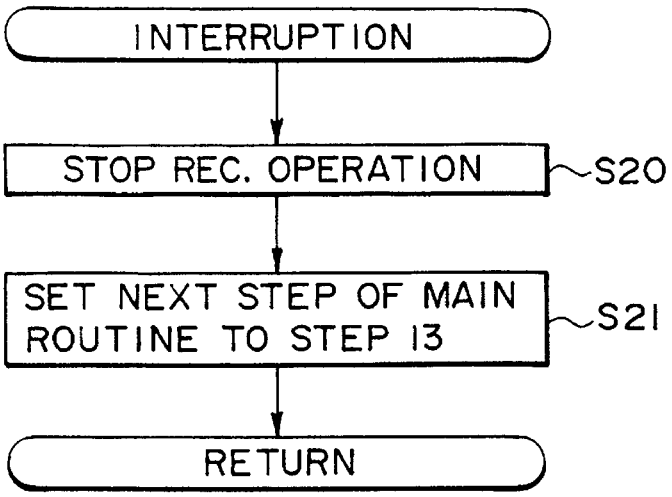

FIGS. 19 and 20 are flow charts of a main routine and an interruption routine for the control operation of the apparatus according to the FIG. 18 embodiment.

In FIG. 19, when the main switch of the recording apparatus is actuated, the initial setting operation is effected for the CPU, the RAM or the like (of the controller) (not shown) is performed at step S11. After the initial setting is completed, the interruption operation is permitted at step S12.

At step S13, the discrimination is made as to whether or not the door 220 is opened, using the door sensor 222. If so, the operation proceeds to a step S15 where instructions are sent to the solenoid 230 to attract the engaging member 227. Until the door 220 is closed, the checking operation is performed in the loop, at step S13.

On the other hand, if the door 220 is closed, or if it is closed already at the time of the actuation of the main switch, the operation proceeds to a step S14 where the solenoid 230 is deenergized, and the recording head 201 is capped at step S16. After the capping, the depression of the record start key by the operator is awaited in the closed loop, at step S17.

In response to the depression of the record start key, the recording operation starts at step S18. When the predetermined number of sheets are processed for the recording, the recording head 201 is capped at step S19.

After the completion of the capping, the operation returns to the step S17 for the preparation for the next recording operation, that is, the next depression of the record start key is awaited.

A description will now be made as to the interruption routine of FIG. 20. When the door 220 is opened, and the door sensor 222 detects the event, an interruption request is supplied to the CPU of the controller. If the operation in the main routine of FIG. 19 is at a step subsequent to the step S13, the interruption is already permitted, and therefore, the control operation proceeds to the interruption routine of FIG. 20.

In FIG. 20, at step S20, the recording operation is stopped on the premise that the door 220 is opened during the recording operation. More particularly, the driving pulse for the recording head 1 and the ink ejection pulse is stopped, and the driving pulse for the stepping motor 208 is stopped, and the motion of the carriage 202 is stopped. The recording operation stepping control does not adversely affect the recording apparatus, even if it is carried out not during the recording operation. At step S21, before the operation returns to the main routine, the step number is changed to "13". By the change of the step number, the control operation starts at the step S13 in the main routine, immediately after the operation returns thereto from the interruption routine.

Because of the above-described interruption routine, the capping operation is always effected whenever the door 220 is opened or closed.

If the door 220 is opened or closed during the recording operation, the recording material is detected by the sheet discharge sensor 216, and the sheet jam is discriminated because the recording material exists at the position of the sheet discharge sensor 216 before the record start key is depressed. Therefore, the sheet jam lamp 19 of FIG. 14 is lit to prompt the operator to remove the recording material and to reactuate the main switch.

The similar advantageous effects as in the previous embodiment are provided. More particularly, the recording head 201 is left without being capped only when the main switch is deactuated during the recording operation or when the door 220 is opened during the recording operation. Therefore, the recording head is not left without being capped, except when the operator deliberately does it.

Accordingly, the possibility that the recording head 1 is left without being capped, can be eliminated almost completely. Therefore, the solidification of the ink in the recording head 201 due to the inadvertent error of the operator, can be prevented.

Additionally, according to this embodiment, the door 220 is permitted to be opened even if the main switch is not actuated. Therefore, as contrasted to the foregoing embodiment, the recording head 1 can be replaced more safely. In addition, the number of structural parts of the locking mechanism for the door 220 can be reduced, thus decreasing the manufacturing cost.

In the foregoing embodiments, four recording heads 1*a*–1*d* are used in the color ink jet recording apparatus. However, the present invention is applicable to the apparatus having a single recording head (single ink ejecting portion) for a single color recording, and to an ink jet recording apparatus capable of tone recording using plural recording heads providing different densities in the same color, or another ink jet recording apparatus, irrespective of the number of the recording heads.

The replaceable recording heads 201A–201D may be in the form of a recording head comprising separate ink ejector and ink container which are connected through a coupler and tube, for example, in the form of a recording head having an ink ejector without the ink container, or in the form of a cartridge type recording head having an integral ink ejector and the ink container.

The present invention is applicable to a serial recording type ink jet recording apparatus having a recording head mounted on a carriage movable along the recording material or to a line type ink jet recording apparatus using a line recording head covering the entirety or a substantial part of the recording width for the recording material. The same advantageous effects can be provided.

The safety of the recording head when the door is opened is further assured by preventing movement of the recording head from the non-recording position (capping position) to the recording region, when the door is opened.

A description will now be made as to the movement limiting means for the recording head interrelated with the opening and closing of the door.

Figure 21:
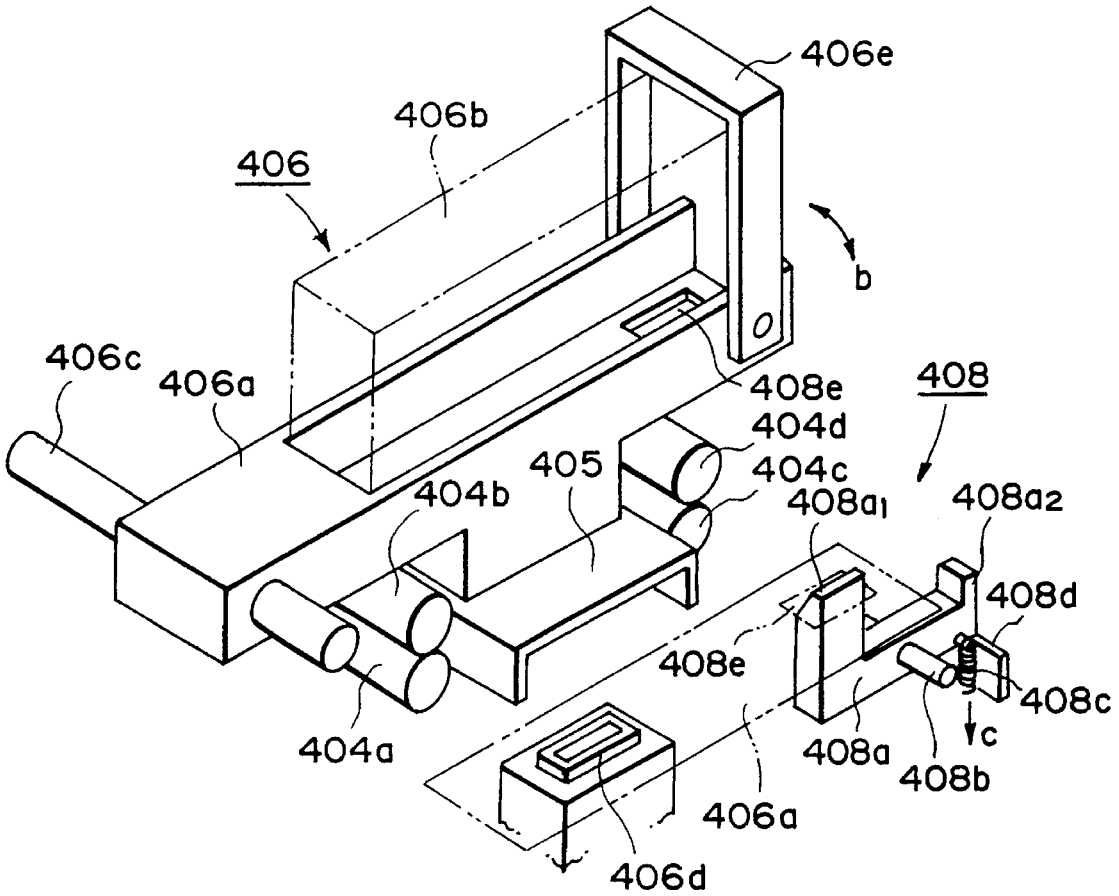
FIG. 21 is a perspective view of a further example of a carriage locking mechanism.

Referring to FIG. 21, the movement preventing means 408 is shown. A channel-like movement preventing member 408*a* is mounted for rotation about a shaft 408*b* at the home position for the carriage 406*a*. The movement preventing member 408 is urged in the direction c in FIG. 21 by a tension spring 408*c*. It is retained with the bottom end contacted to the stopper 408*d*. A taper 408*a*1 is formed at an end of the movement preventing member 408*a*. At a predetermined position on the bottom surface of the carriage 406*a*, an engaging hole 408*e* is formed.

Figure 22:
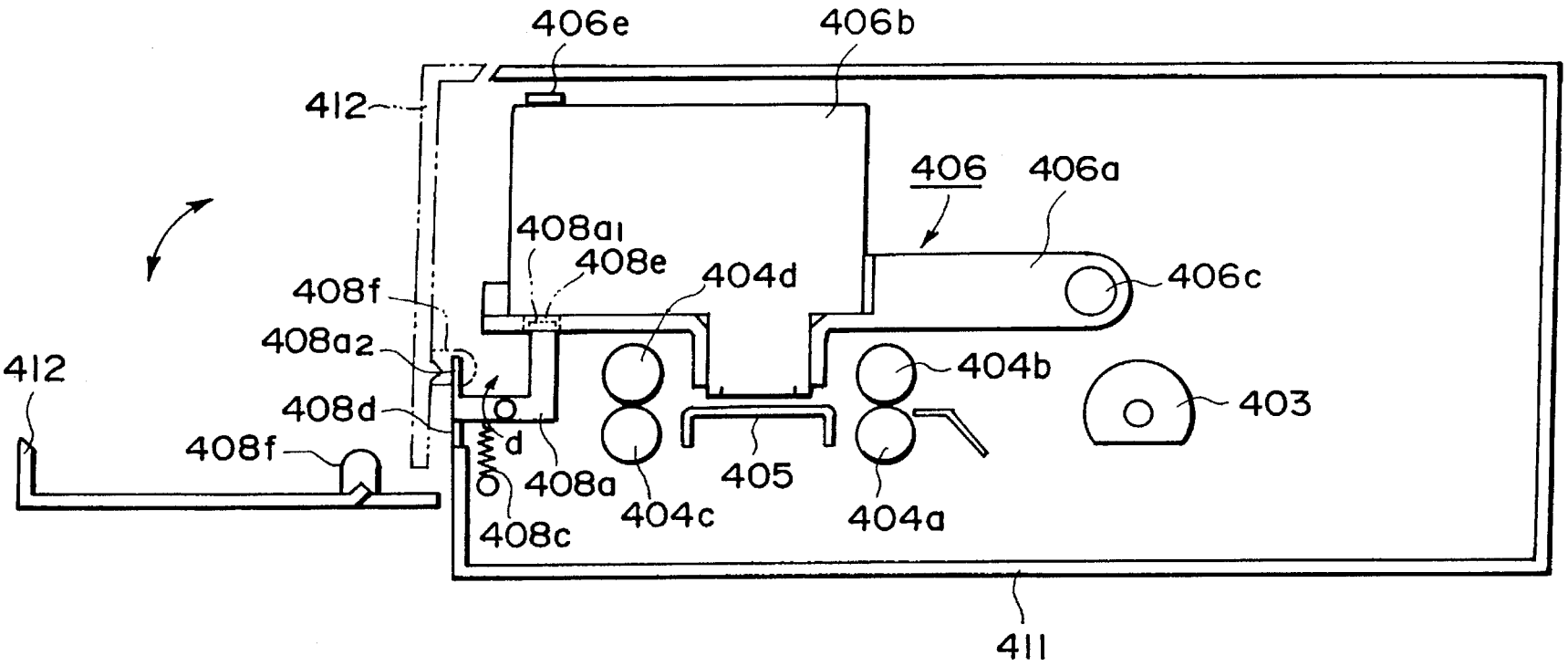
FIG. 22 is a sectional view of a recording apparatus using the mechanism shown in FIG. 21.

The preventing member 408 is operated in interrelation with the opening and closing of the cover. More particularly, as shown in FIG. 22, the recording apparatus has such a structure that a cover 412 is openable from the main assembly 411 of the apparatus. The inside surface of the cover 412 is provided with a projection 408*f*. The projection 408*f* urges an end 408*a*2 of the preventing member 408*a* when the cover 412 is closed. When the cover 412 is opened, it releases the urging.

Therefore, as shown by the chain lines of FIG. 22, when the cover 412 is closed, the projection 408*f* urges the end 408*a*2, and by the urging, the preventing member 408 rotates in the direction d about the shaft 408*b*, so that the tapered portion 408*a*1 and the engaging hole 408*e* are in the released state. Therefore, the carriage 406*a* is movable along a slide rail 406*c*, so that the recording operation can be carried out without obstruction.

When, on the other hand, the cover 412 is opened for the purpose of interchanging of the recording head 406*b* or the like, the projection 408*f* ceases the urging of the end 408*a*2 of the preventing member 408*a*, so that the preventing member 408*a* rotates by the tension of the spring 408*c* until it abuts the stopper 408*d*. If the carriage 406*a* is at the home position (the chain line position of FIG. 21), the leading end of the tapered portion 408*a*1 is engaged into and locked into an engaging hole 408*e* formed in the carriage 406*a* is indicated by solid lines. Therefore, the carriage 406*a* is prevented from movement along the slide rail 406*c*, and therefore, the unexpected movement of the carriage 406*a* is prevented at the time of the head exchanging operation.

If the carriage 406*a* is stopped at the position other than the home position with the cover 412 opened, due to an unexpected power supply failure or the like, the bottom of the carriage lowers the preventing member 408*a* along the tapered portion 408*a*1, when the carriage 406*a* is moved to the home position, and in addition, the tapered portion 408*a*1 enters the engaging hole 408*e* by the urging of the spring 408*c*. Therefore, the carriage 406*a* is prevented from movement from the home position.

Thus, when the cover 412 is opened, the movement preventing member 408*a* operates in association with the opening of the cover 412 to limit the movement of the carriage 406*a* disposed at the home position. When the cover 412 is closed, the movement prevention for the carriage 406*a* is released. Therefore, the carriage 406*a* is not inadvertently moved upon the exchange of the recording head 406*b* or the jam clearance operation or the like.

Opening means 409 is provided to open and separate between the conveying roller 404*a* and the pinch roller 404*b* and between the discharging roller 404*c* and the pinch roller 404*d* to facilitate the jam clearance operation when the recording sheet 402 is jammed.

Figure 23:
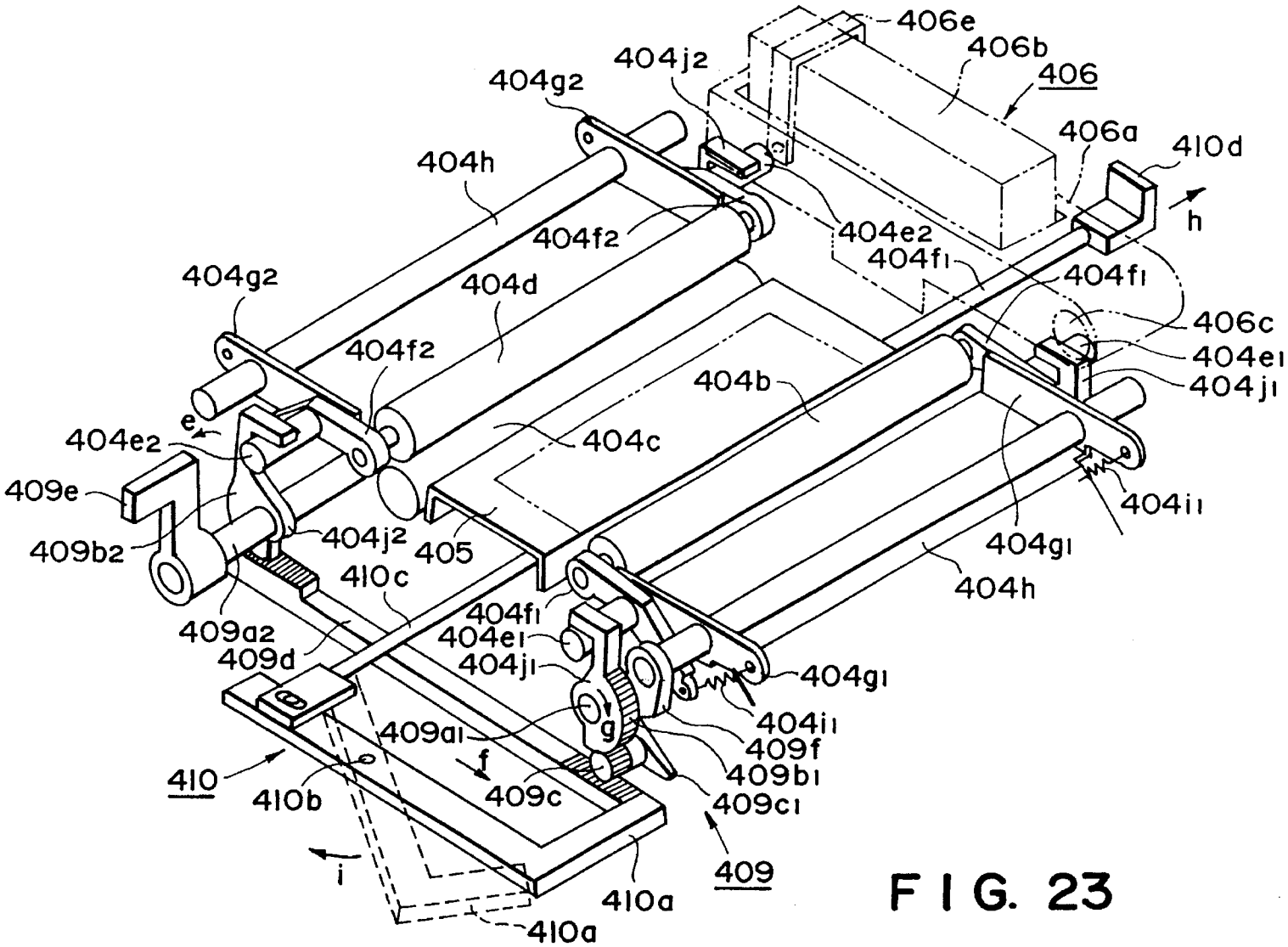
FIG. 23 is a perspective view of another example of the release preventing means for sheet conveying means.

As shown in FIG. 23, hooks 404*j*1 and 404*j*2 are fixed on the shafts 409*a*1 and 409*a*2. The hooks 404*j*1 and 404*j*2 have integral gear portions 409*b*1 and 409*b*2 rotatable about the shafts 409*a*1 and 409*a*2. One portion 409*b*1 of the gear portions is meshed with a rack 409*d* through a cam gear 409*c*, and the other gear portion 409*b*2 is meshed directly with a rack 409*d*.

An operating lever 409*e* is mounted on the shaft 409*a*2. Therefore, when the operating lever 409*e* is rotated in the direction e in FIG. 23, the hook 404*j*2 rotates in the direction e to be disengaged from a pressing shaft 404*e*2, and simultaneously, the rack 409*d* slides in the direction f. Therefore, the hook 404*j*1 rotates in the direction g, so that it is disengaged from the pressing shaft 404*e*1, and the pressing between the conveying roller 404*a* and the pinch roller 404*b* and the pressing between the discharging roller 404*c* and the pinch roller 404*d* are released. An opening preventing member 410*a* is in the broken line state of FIG. 23.

At this time, arms 404*f*1 and 404*f*2 are pulled by the springs 404*i*1 and 404*i*2 and are retained at a position where parts of the arms 404*f*1 and 404*f*2 are contacted with a supporting shaft 404*h*. Further, when the operating lever 409*e* is rotated in the direction e, the arm 409*c*1 mounted on the cam gear 409*c*1 rotates the cam 409*f* fixed on the supporting shaft 404*h*, and raises the upper guide 404*g*1 and the pinch roller 404*b*, as shown in FIG. 23.

By doing so, the sheet conveying means 404 is opened widely so as to facilitate the jam clearance operation to remove the recording sheet 402 from the conveyance passage.

In the state of FIG. 23 in which the sheet conveying means 404 is opened, the upper guide 404*g*1 and the pinch roller 404*b* enter the scanning region of the carriage 406*a*. This means that if the operating lever 409*e* is operated when the carriage 406*a* is stopped at the position other than the home position, the upper guide 404*g*1 and the pinch roller 404*b* interfere with the carriage 406*a*. In view of this, the present embodiment is such that only when the carriage 406*a* is at the home position, the opening of the sheet conveying means 404 is permitted, and when the carriage 406*a* is at the other position, the opening of the conveying means 404 is prevented. This is done by the opening preventing means 410.

As shown in FIG. 23, the opening preventing means 410 comprises L-shaped opening preventing member 410*a* rotatably mounted about a shaft 410*b*. When the opening preventing means 410*a* is in the state shown by the solid line of FIG. 23, an end of the rack 409*d* abuts the opening preventing member 410*a*. To the opening preventing member 410*a*, an end of a connecting shaft 410*c* is rotatably mounted, and to the other end of the connecting shaft 410*c*, the L-shaped locking member 410*d* is mounted. When the carriage 406*a* moves to the home position, the locking member 410*d* is engaged with the bottom end of the carriage 410*a* to slide the connecting shaft 410*c*, in a direction h in FIG. 23.

Therefore, when the carriage 406*a* is at the position other than the home position, the opening preventing member 410*a* is at the position indicated by the solid line in FIG. 22 to limit the sliding of the rack 409*d* in a direction f. Therefore, it is not possible to move the operating lever 409*e* in the direction e, so that the opening of the sheet conveying means 404 is prevented.

When the sheet conveying means 404 is opened for the jam clearance operation or the like, the connecting shaft 410*c* slides in the direction h by the movement of the carriage 406*a* to the home position, the opening preventing member 410*a* rotates to the position indicated by the broken lines in FIG. 23, and therefore, the rack 409*d* is in a slidable state, and therefore, the sheet conveying means 404 can be opened by operating the operating lever 409*e*. At this time, the carriage 406*a* is prevented from moving by the movement preventing means 408, as described hereinbefore.

As described in the foregoing, according to the present invention, the sheet conveying means 404 can be opened when the carriage 406*a* is at the home position. When the carriage 406*a* is at the other position, the opening is prevented by the opening preventing means 410, so that the damage of the carriage 406*a* or the recording head 406*b* or the like can be prevented.

In the foregoing description, the recording means is in the form of an ink jet recording type. Preferably, it is of a type wherein an electrothermal transducer is energized in accordance with record signals to heat the ink so as to produce film boiling, which creates a bubble so as to eject the ink through the ejection outlet.

The present invention is particularly suitably usable in an ink jet recording head and recording apparatus wherein thermal energy produced by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from the nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head, it may be a single corresponding to a single head color ink, or may be plural heads corresponding to the plurality of ink materials having different recording color or density. The present invention is effectively applicable to an apparatus having at least one of a monochromatic mode (mainly black), a multi-color mode with different color ink materials and/or a full-color mode using a mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in a usual recording apparatus of this type, the ink may be such that it is liquid within the temperature range when the recording signal is the present invention and is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

In the foregoing description, the recording means is in the form of an ink jet recording type, but the present invention is applicable to other types such as thermal transfer type recording, heat sensitive recording; or to an impact type recording system such as wire dot type recording system.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus comprising:

a carriage for moving a recording head in a recording region for effecting recording on a recording material and in a non-recording region adjacent to said recording region;

mounting means, in said carriage, for detachably mounting said recording head to said carriage;

operating means for permitting mounting and demounting of said recording head by said mounting means;

prohibiting means, in said carriage, for prohibiting operation of said operating means; and releasing means for releasing the prohibiting operation of said prohibiting means, only when said carriage is at a predetermined position in said non-recording region.

2. A recording apparatus according to claim 1, wherein said recording head ejects ink to effect recording.

3. A recording apparatus according to claim 1, wherein said recording head includes an electrothermal transducer for generating thermal energy for ejecting ink.

4. An ink jet recording apparatus comprising:

a carriage for moving an ink jet recording head in a recording region for effecting recording by ejecting ink from an ink ejection outlet of said ink jet recording head onto a recording material and in a non-recording region adjacent to said recording region;

mounting means, in said carriage, for detachably mounting said ink jet recording head to said carriage;

operating means for permitting mounting and demounting of said ink jet recording head by said mounting means;

prohibiting means, in said carriage, for prohibiting operation of said operating means; and releasing means for releasing the prohibiting operation of said prohibiting means, only when said carriage is at a predetermined position in said non-recording region.

5. An ink jet recording apparatus according to claim 4, further comprising capping means, in said non-recording region, for capping an ejection outlet of said ink jet recording head.

6. An ink jet recording apparatus according to claim 4, wherein said ink jet recording head includes an electrothermal transducer for generating thermal energy for ejecting ink.

7. An ink jet recording apparatus according to claim 4, further comprising carriage movement preventing means for preventing movement of said carriage, said carriage movement preventing means being sandwiched between a side of said carriage and said mounting means and being operable when a releasing lever of said mounting means permits said ink jet recording head to be dismounted.

8. An ink jet recording apparatus according to claim 4, further comprising:

a carriage guiding surface provided in said carriage to guide said ink jet recording head when said ink jet recording head is being mounted to or dismounted from said carriage;

guiding means for inclining an ejection side surface of said ink jet recording head relative to said carriage guiding surface when a releasing lever of said mounting means permits the ink jet recording head to be dismounted, wherein a height from said guiding means to said carriage guiding surface is greater than a height from a guiding surface of said ink jet recording head to said ejection side surface of said ink jet recording head.

9. An ink jet recording apparatus according to claim 8, wherein said guiding means also functions as a grip for said releasing lever of said mounting means.

10. An ink jet recording apparatus according to claim 8, wherein said guiding means is a part of a guiding arm of said mounting means and operates in association with operation of said releasing lever of said mounting means.

11. An ink jet recording apparatus according to claim 4, further comprising:

an openable cover for covering a movable range of said carriage;

a locking member, coupled to said carriage, for preventing movement of said carriage, said locking member being interrelated with opening and closing of said cover, so as to be engaged with a portion of said carriage to prevent movement of said carriage when said cover is opened and so as to be disengaged from the portion of said carriage to permit movement of said carriage when said cover is closed.

12. An ink jet recording apparatus according to claim 5, further comprising:

a main switch;

a casing having an openable door so as to permit mounting and dismounting of said ink jet recording head to and from said carriage external to said casing, and for encasing said carriage and said capping means; and control means for permitting opening or closing of said door only when said main switch of said apparatus is in an on-state.

13. An ink jet recording apparatus according to claim 12, wherein said control means includes a control circuit for causing said capping means to cap an ejection side surface of said ink jet recording head when said door is closed.

14. An ink jet recording apparatus according to claim 4, further comprising:

feeding means including a roller to form a nip to feed the recording material;

releasing means for releasing said nip.

15. An ink jet recording apparatus comprising:

a carriage for moving an ink jet head cartridge in a recording region for effecting recording by ejecting ink from an ink ejection outlet of said ink jet head cartridge onto a recording material and in a non-recording region adjacent to said recording region;

mounting means, in said carriage, for detachably mounting said ink jet head cartridge to said carriage;

operating means for permitting mounting and demounting of said ink jet head cartridge by said mounting means;

prohibiting means, in said carriage, for prohibiting operation of said operating means; and releasing means for releasing the prohibiting operation by said prohibiting means, only when said carriage is at a predetermined position in said non-recording region.

16. An ink jet recording apparatus according to claim 15, further comprising capping means, in said non-recording region, for capping an ejection outlet of said ink jet head cartridge.

17. An ink jet recording apparatus according to claim 15, wherein said ink jet head cartridge includes an ink jet recording head.

18. An ink jet recording apparatus according to claim 17, wherein said ink jet recording head includes an electrothermal transducer for generating thermal energy for ejecting ink.

19. An ink jet recording apparatus according to claim 15, wherein said ink jet head cartridge includes an ink tank.

* * * * *

UNITED STATES PATENT AND TRADEMARK OFFICE

CERTIFICATE OF CORRECTION

PATENT NO. : 5,579,039

DATED : November 26, 1996

INVENTORS : MITSURU KURATA ET AL.

It is certified that error appears in the above-identified patent and that said Letters Patent is hereby corrected as shown below:

COLUMN 1

Line 36, "indicates" should read --indicate-;
Line 49, "at rest" should read --at the rest--;
Line 55, "emergency" should read --an emergency--;
Line 66, "the ink" should read --ink--.

COLUMN 2

Line 49, "the a" should read --a--.

COLUMN 4

Line 65, "head" should read --heads--.

COLUMN 9

Line 21, "interfere the" should read --interfere with the--.

COLUMN 12

Line 4, "in" should read --in an--;
Line 60, "A particularly," should read --In particular,--.

UNITED STATES PATENT AND TRADEMARK OFFICE

CERTIFICATE OF CORRECTION

PATENT NO. : 5,579,039

DATED : November 26, 1996

INVENTORS : MITSURU KURATA ET AL.

It is certified that error appears in the above-identified patent and that said Letters Patent is hereby corrected as shown below:

COLUMN 13

Line 43, "on" should be deleted;
Line 67, "in" should read --is in--.

COLUMN 14

Line 21, "interfere" should read --interfere with--;
Line 57, "door 220 closed, the door 220 is can" should read --door 220 is closed, the door 220 can--.

COLUMN 17

Line 9, "is" should read --as--.

UNITED STATES PATENT AND TRADEMARK OFFICE

CERTIFICATE OF CORRECTION

PATENT NO. : 5,579,039

DATED : November 26, 1996

INVENTORS : MITSURU KURATA ET AL.

It is certified that error appears in the above-identified patent and that said Letters Patent is hereby corrected as shown below:

COLUMN 19

Line 59, "single corresponding to a single head color" should read --single head corresponding to a single color--.

COLUMN 20

Line 35, "recording;" should read --recording,--.

Signed and Sealed this

Third Day of June, 1997

*Attest:*

*Attesting Officer*

BRUCE LEHMAN

*Commissioner of Patents and Trademarks*